United States Patent [19]

Ransohoff

[11] Patent Number: 4,481,652

[45] Date of Patent: Nov. 6, 1984

[54] IRRADIATION DEVICE

[75] Inventor: Jackson A. Ransohoff, Bethesda, Md.

[73] Assignee: Neutron Products Inc., Dickerson, Md.

[21] Appl. No.: 225,599

[22] Filed: Jan. 19, 1981

[51] Int. Cl.[3] ..... G21K 5/00

[52] U.S. Cl. ..... 378/69

[58] Field of Search ..... 250/453.1; 378/69, 68

[56] References Cited

U.S. PATENT DOCUMENTS

| | | | |
|---|---|---|---|
| 3,142,759 | 7/1964 | Jefferson et al. | 378/69 |
| 3,564,241 | 2/1971 | Ludwig | 378/69 |
| 4,066,907 | 1/1978 | Tetzlaff | 378/69 |

*Primary Examiner*—Alfred E. Smith
*Assistant Examiner*—Carolyn E. Fields
*Attorney, Agent, or Firm*—Bernard, Rothwell & Brown

[57] ABSTRACT

Carriers, after being loaded with product to be irradiated, are transported by an input-output conveyor system into an irradiation chamber where they are received in a horizontal arrangement on racks which may support different sizes and numbers of carriers. The racks are moved by a chamber conveyor system in an endless rectangular path about a radiation source. Packers shift the carriers on the racks to maintain nearest proximity to the radiation source. The carriers are shifted in position on each rack during successive rack cycles to produce even radiation exposure. The carriers may be loaded singly onto successive racks during a first cycle of movement thereof about the source, with loading of additional carriers, and/or unloading of carriers, onto each rack occurring on subsequent rack cycles of movement.

11 Claims, 20 Drawing Figures

IRRADIATION DEVICE

BACKGROUND OF THE INVENTION

Ionization radiation, as from cobalt-60 sources, has become widely used for such diverse purposes as the modification of certain polymers, the sterilization of a variety of packaging materials and medical supplies, the pasteurization of foodstuffs and cosmetics, and other applications, all involving the irradiation of discrete packages, many of which are traditionally rectangular in cross section. In order to make efficient use of the radiation energy, which is expensive, it is desirable to pack the products to be processed as closely as possible around the source. Furthermore, within any such array, the exposure would be nonuniform, and in order to obtain the necessary uniformity of exposure, it is desirable that each package of product occupy each position in which the exposure rate is significantly different, for approximately the same length of time as every other package of product. Finally, in order to minimize labor and maximize the use of the radiation, the shield and the equipment, it is also desirable to move product through the radiation field remotely.

By prior art means, numerous methods have been established for moving the product through a radiation field in carriers in such a manner that the product is close packed in a direction parallel to the plane of the source and irradiated first on one side, and then on the other to achieve a satisfactory degree of uniformity. Such prior art means also provide for close packing of product in the vertical dimension in said carriers. However, such prior art means do not provide for efficient packing in the dimension normal to the plane of the source. If products of highly uniform densities and dimensions are to be processed, prior art methods approach ideal close packing because the rows of product may be placed in close proximity to each other and still have sufficient clearance between rows to provide for reliable operation. However, for the irradiation of packages of varying thickness, prior art systems are seriously deficient in the use of available space; and for the processing of materials of varying densities, prior art systems frequently are unable to efficiently deliver the radiation at a desirable maximum-to-minimum dose ratio.

The purpose of the present invention is to provide a means whereby it is practical to move the product through a radiation field wherein the product to be irradiated is closely packed in the dimension normal to the plane of the source as well as in the vertical planes and in the dimension parallel to the plane of the source for a wide variety of package thicknesses. In this way, it is practical to achieve a modest increase in the efficiency of irradiating packages of uniform dimensions and a major improvement in the efficiency of processing product packages of different thicknesses Same major improvement permits a greater degree of freedom in the selection of package thickness to accommodate materials of different density thereby making it practical to achieve the desired degree of uniformity without sacrificing radiation or irradiator utilization efficiency.

The objectives of the present invention are accomplished by organizing product carriers in an irradiator in a novel way so that they traverse the source in a rank of two or more carriers instead of single file as in the case of prior art methods. Thus, the clearance between files that is required by prior art techniques is eliminated; and more important, the present invention permits the efficient use of a variety of carrier widths within the same irradiator. Consider, for example, a prior art four pass irradiator designed to accommodate cartons 18" thick. By prior art, carriers of perhaps 19" width would traverse the irradiation cell parallel to the source array in single file on tracks no closer than perhaps 20" apart. Assuming the source array is in an east-west plane, the product carriers would first proceed east on the outside track south of the source the length of the cell, then move north one file, proceed west the length of the cell, then be moved north to the inner track on the north side of the source, proceed east the length of the cell, and then north to the outer file, and west again to complete the fourth pass. Such prior art irradiator could not accommodate a package of greater thickness than 20" under any circumstances, and thinner packages are irradiated only at great sacrifice in system efficiency. A ten inch thick package, for example, would occupy only 55% of the space on the carrier, even if it were the ideal length and height, and if placed on 11" carriers, such packages would still traverse the irradiator on 20" centers resulting in a substantial loss in irradiation efficiency.

By practice of the present invention, however, the irradiator carriers are organized in a rank of two or more carriers on a rack which permits the inner carrier to be pushed as close to the source as reasonable clearance allows, and for adjacent carriers to be in contact with each other on each rack. A rack 48" wide for example, which would accommodate two or three 16" carriers, could also accommodate one 12" carrier, one 16" carrier and one 20" carrier, or any other combination up to the overall limit of 48" aggregate width while having the product as close to the source as possible in every case.

Under prior art practices, the ideal of packing product close to the source has been practical only by means of manual rearrangement or strict limitations on package size because prior art had not contemplated a practical arrangement where product could be moved remotely and automatically through an irradiation field in such a manner as to have each product carrier close packed both parallel and normal to the plane of the source, regardles of carrier width, over a wide range of carrier widths. The present invention overcomes this deficiency in principle by conceiving the hitherto untried method whereby carriers traverse the irradiation chamber parallel to the source array in a rank, rather than single file, and further providing means for packing the individual carriers in close proximity to each other within each rank and to the source. This ideal array is made practical by the introduction of a novel means of relocating the carriers on a moving rack after each circumnavigation of the source so that each carrier in turn occupies each position.

SUMMARY OF THE INVENTION

The irradiation apparatus of the present invention includes an irradiation chamber including a centrally located radiation source which is movable into the radiation chamber from a position at the bottom of a pool located beneath the irradiation chamber itself. The product to be irradiated is carried and supported during its transport by product carriers, a plurality of which must be provided.

Externally of the irradiation chamber, an accumulation station including a first accumulating conveyor is provided wherein the empty carriers are loaded with the product to be irradiated. The carriers, which are preferably suspended from an overhead conveyor, are then transported through labyrinth-like passageways to a shuttle member whose function is to transfer carriers to and from the irradiation chamber, and to change the position of the carrier with respect to each other within the irradiation chamber.

Within the shielded irradiation chamber itself, a number of conveyor systems are operable which transport the carriers in a generally rectangular fashion about the radiation source. The carriers are supported by racks within the chamber, these racks being themselves conveyed about the source. The number of carriers on each rack will depend upon the number and size of carriers in use which, in turn, is determined by the dimensions and density of the products being irradiated. Most simply, the invention is practiced using carriers of all the same dimensions at any given time, and the first embodiment is operated in such a fashion. However, it is also practical to operate the system using carriers of differing dimensions provided that certain restraints are observed. For example, the first embodiment uses eight carrier racks each of which is 48 inches long within the irradiator. The discussion of the preferred embodiment describes in detail the operation of the system with two carriers of equal dimension on each rack, and describes very briefly how the system can be operated with more than two carriers per rack.

However, the system may also be operated with different sized carriers in use at the same time provided that the proper sequencing is observed. For example, the first embodiment employs two carriers each about 16 inches wide on each rack for simplified operation; and the capacity of the system can be increased somewhat by the use of a third carrier on each rack without complicating the mechanism of operation. Moreover, although the control program governing the operation of the system would have to be more complex, the system could be operated, for example, in a manner which provides for the sequential loading of eight carriers of 20 inches in thickness, followed by eight carriers of 16 inches in thickness, followed by eight carriers of 12 inches in thickness, and as long as that sequence is maintained during subsequent unloading and loading, there would always be a 48 inch width of carrier on each rack, and each carrier would occupy each position in turn for the most efficient irradiation of products of widely differing dimensions and properties.

While travelling about the source in a longitudinal direction with respect thereto, the carriers are maintained with substantially zero clearance therebetween, and with only minimal clearance between themselves and the radiation source. In this manner, little radiation is wasted, thereby increasing the radiation utilization efficiency of the system, and increasing productivity.

In order to ensure that each carrier, and the product carried thereon, receive a uniformily-applied dose of radiation, the carriers are not turned as they progress around the source, thereby exposing first one side and then the other and after each traverse around the source, the positions of the carriers on each rack are changed so that in turn, each carrier occupies each position within the chamber. In this manner, after a number of rectangular traverses equal to the number of carriers on each rack, each carrier will have received the same dose of radiation as every other carrier in the lot, and the radiation will have been applied equally to both sides of the carrier.

After each group of carriers has been loaded onto the rack upon which they will reside throughout the entirety of their time in the irradiator, the rack is moved to a position at which all the carriers on said rack are pushed in a direction normal to the source so that they touch one another and are as close as possible to the source. After that, the rack moves parallel to the plane of the source, to the other end of the irradiation chamber, after which it is transferred across the other end of the chamber and is returned, again, proceeding parallel to the plane of the source. However, after the rack has been transferred to the other side of the source, the carriers are no longer as close to the source as possible. Accordingly, before beginning the return longitudinal trip, the rack pauses at a station where a horizontal packer pushes the row of carriers normal to the source to achieve, once again, the close packing of the carriers to each other and to the source.

A wide variety of novel or prior art methods may be used to operate the conveyor within the irradiator. However, most prior art systems employ microswitches and drive mechanisms within the radiation field, a practice that decreases the reliability of the system, and increases the cost and level of maintenance. In the first embodiment of the present invention, practical means for removing most of the drive mechanisms, and the limit switches used for control, from the radiation field were successfully provided.

All movements of the carriers via the conveyor systems located within the irradiation chambers are controlled by a number of motors arranged in a room located above the radiation chamber itself. These motors are equipped with mechanical analog devices whose displacements were proportional to the displacement of the corresponding conveying mechanisms within the irradiation chamber. Thus, the operation of the conveyor systems within the irradiation chamber may be controlled via the mechanical analog devices, thereby controlling the positions and movements of the carriers within the irradiation chamber at all times.

In the preferred mode, the system is controlled via a programmable computer whose programming contains information relating to the sequencing of operations of each of the conveyor mechanisms of the system. In the case of a detected fault or problem within the system, operations may be caused to cease and the source returned to its position at the bottom of the pool below the irradiation chamber.

DETAILED DESCRIPTION OF THE PREFERRED EMBODIMENT

Overview

Figure 1:
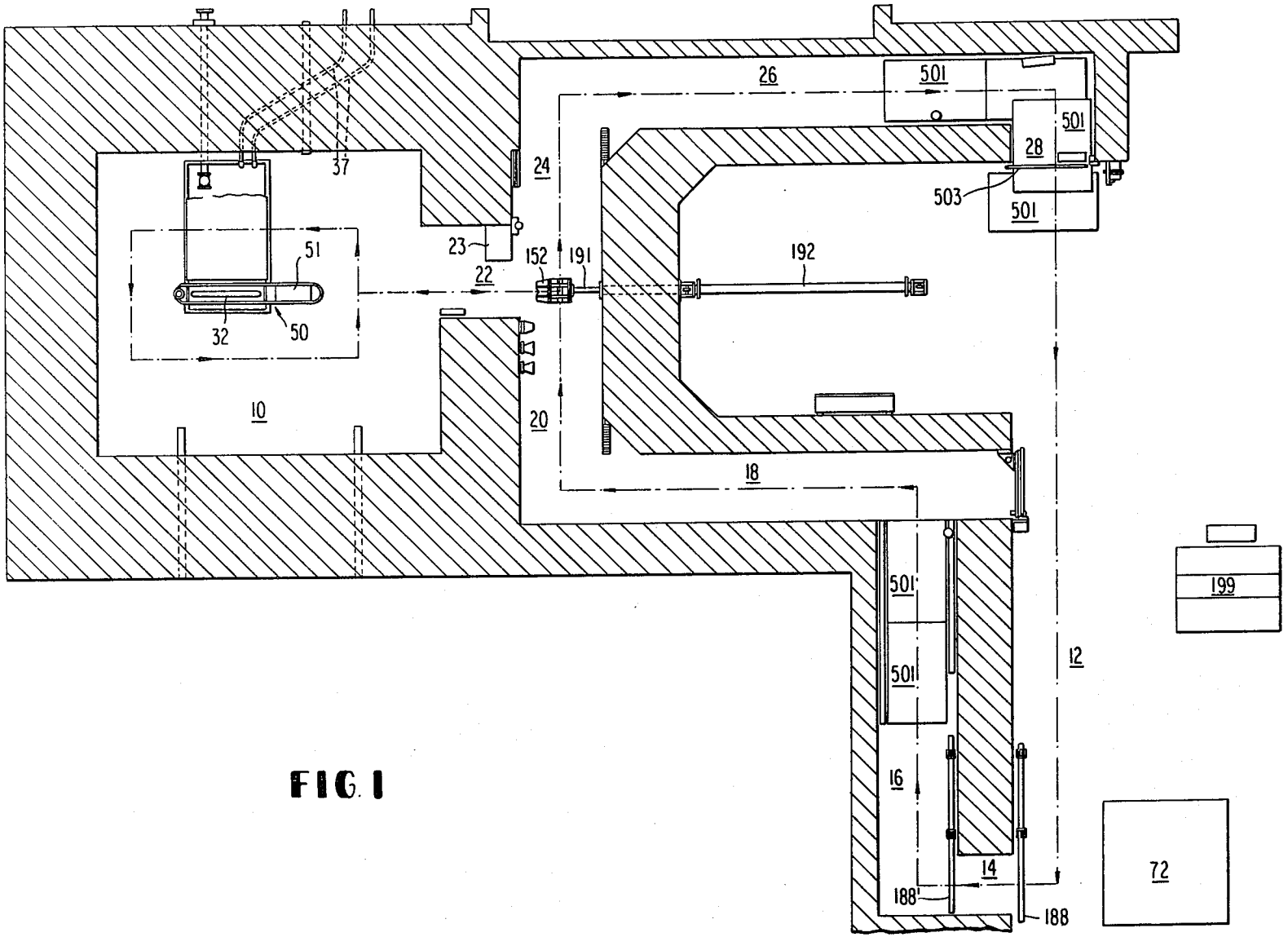
FIG. 1 is a top sectional partially schematic view of an irradiation installation according to the present invention.

Turning now to the drawings, and in particular FIG. 1 thereof, the general layout of the irradiation apparatus is depicted, wherein numeral 10 generally designates the irradiation chamber. The product to be irradiated is delivered to the chamber 10 via a labyrinth-like configuration including an accumulation area 12, double doors 14, accumulation area 16, passageways 18 and 20 and doorway 22. Irradiated product leaving the chamber 10 passes through doorway 22, passages 24, 26, a second doorway or gate 28, and back to the accumulation area 12. The circuitous route of the product to be irradiated is schematically indicated by a series of arrows in FIG. 1. Other labyrinth configurations may also be used.

Product Carriers

Figure 2:
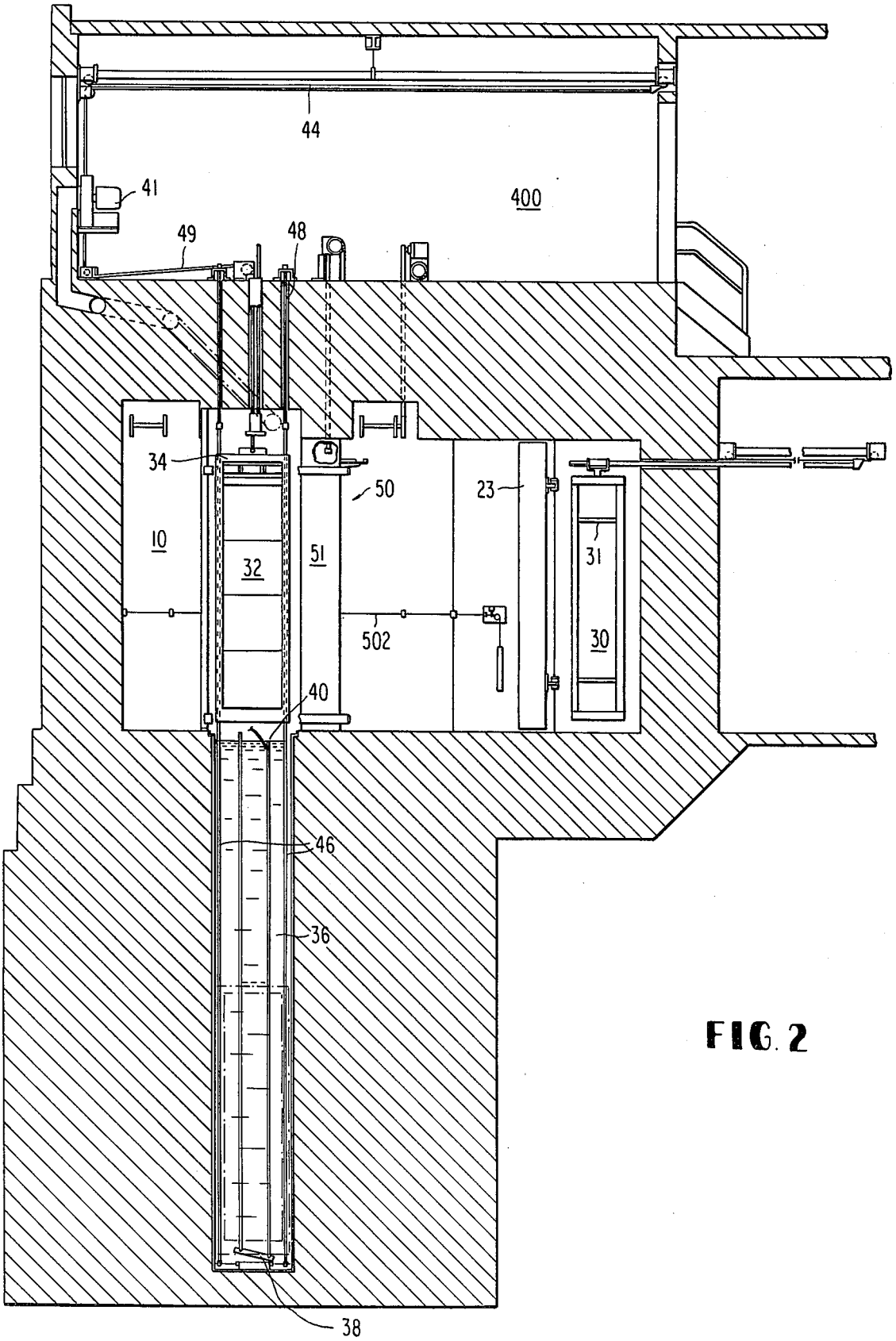
FIG. 2, is a sectional side elevation of a part of the installation of FIG. 1 illustrating the radiation chamber and mechanisms operatively associated therewith.

The product to be irradiated is suitably transported throughout the process by means of product carriers 30, one of which is seen, for example, in FIG. 2. In the first embodiment, each product carrier is approximately nine feet in height and can carry 15 to 40 cubic feet of product, depending on the other dimensions in use. The product is normally supported on shelves provided in the carriers, which may be adjustable in order to accommodate products of differing sizes. The carriers are rectangular in shape and are fabricated, for the most part, of aluminum so as to be relatively light weight.

The carriers are always supported during their travel by means of overhead conveyor/support apparatuses, which are described in more detail hereinafter. In order to support the carriers 30 during this transport, each carrier is provided with a mushroom shaped member at the upper end thereof (see 64 in FIG. 12), securely fastened to the top surface in a suitable fashion. The mushroom-shaped plate was selected as a supporting means for the carriers because it is slidable upon the rails upon which the mushrooom is normally supported, while not being overly easily movable thereon, as would be the case if the carriers were supported by rollers or the like. Proximate the shelves, the carriers are provided with external horizontally disposed bars 31, which form a part of the generally frame-like structure of the carrier itself. When the carriers are located proximate one another, the bars of one carrier will rub against the bars of the other, preventing the product of one carrier from contacting that of another, in effect providing a miniscule clearance between adjacent carriers.

Radiation Source

In FIG. 2, further details of the irradiation chamber 10 can be seen. In particular, the radioactive source 32, which may be cobalt 60, for example, is depicted as being contained in a source rack 34. The source is movable between the chamber 10 and a radiation absorbing pool 36 arranged therebeneath. The location of the source in the pool is denoted in phantom lines in FIG. 2. At the bottom of the pool is situated a lever 38, which is connected by suitable means to a switch 40. When the source is located at the bottom of the pool, the switch will give an indication of this fact to the operator, indicating that it is safe for personnel to enter the chamber 10. At all other times, the switch will give an indication that the source has left the pool bottom, and any operations within the chamber must be effected through remote control. Although not shown in the drawings, the pool 36 may be connected with further pools, as via conduits 37, these pools being used to store additional source material for when the radioactive material within the source is periodically replaced.

As further seen in FIG. 2, the source 32 is raised and lowered by means of a cable 49 which extends into an upper room 400 which houses the serveral drive motors for controlling carrier movement within the irradiation chamber, and which includes a fan 41 for exhausting air from the chamber 10. The cable 49 is connected to the piston of a large displacement pneumatic cylinder 44 which, in conjunction with a pressurized air source and suitable control apparatus (not shown) controls the raising and lowering of the source. Also shown are a pair of parallel cables 46 connected to tie rods 48 or the like suspended from the floor of the room 400. The cables 46 extend downwardly to the bottom of the pool 36, and are used to guide the movement of the source rack 34 during its travel.

Within the chamber 10 itself, the source is received within a generally oval frame 50. The frame 50 is provided with a fine wire mesh covering or the like, in order to prevent any pool water remaining on the source or sources from falling onto the floor of the chamber 10. As seen in FIG. 1, the right hand side of the frame 50 is provided with a radiation shield 51. The purpose of this shielding is to substantially decrease the amount of radiation reaching the doorway of the cell 10. As will be explained later, the doorway 22 is not completely closed during the time when the source is raised, although it is partially closed by means of a large steel door 23. Thus, by providing the shield 51, the amount of radiation from the source reaching the labyrinth may be substantially decreased.

Most simply, the source may be organized in a manner such that there is a uniform dose over the entire height of the carriers. This has the virtue of simplicity, and the products need pass through the irradiator only once. However, a more efficient method is provided in the following manner:

The source plaque is organized in such a fashion as to provide for uniform exposure over the central six feet of the carrier, for example, allowing the dose rate to decrease across the 18 inch sections at the top and bottom of the carriers. The product in the central section passes through the irradiation field only once, while the product located in the top and bottom sections traverse the entire process multiple times.

At a point halfway through the desired exposure, the product initially located in the nonuniform exposure section at the top of the carrier is relocated for the last half of its exposure in the nonuniform exposure section at the bottom of the carrier. Since the slope of the exposure rate is approximately equal and opposite for the two sections, the change provides the necessary uniformity.

Thus, the best of both worlds is provided—most of the product is processed on a once through basis, yet the radiation leaking out the top and bottom is captured in other products, preferably requiring a higher level of exposure, and hence even less handling.

External Conveyor Systems

Figure 11:
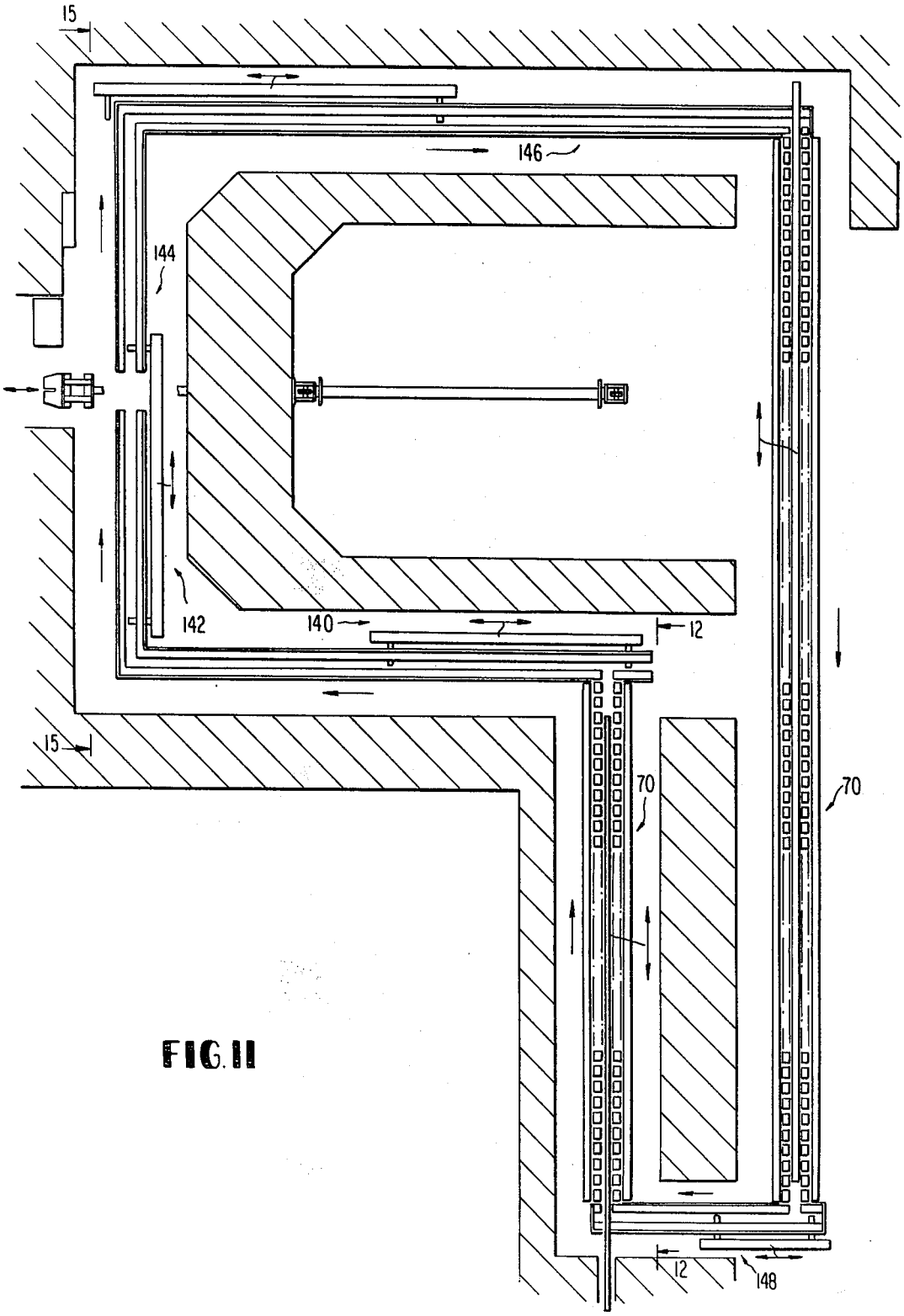
FIG. 11 is a top plan partially schematic of the conveyor mechanisms arranged externally of the radiation chamber and within the labyrinth.

In transporting the carriers from the position where they are loaded with product to the irradiation cell, it is possible to employ many different types of conveyance mechanisms. In the present embodiment, it is desired to suspend the carriers from above, and therefore overhead conveyor mechanisms are used. The particular type of conveyors employed, and the complexity of these conveyors depends upon the complexity of the labyrinth, if any, which in turn depends upon space limitations. In the following, a description of one particular conveyor system is given, by way of illustration only, as it is not intended that the present invention be limited to the specific type of conveyor system used. In fact, the irradiation cell conveyor systems, described hereafter, may be used in situations where there is no labyrinth provided at all, and where access to the radiation cell is effected by merely opening shielded doors. The present invention is further applicable to irradiation systems where the carriers are manually loaded and unloaded. These conveyors may be of the pneumatic, hydraulic or motor driven type, or some combination of these types. The conveyor systems external to the irradiation chamber 10 are schematically illustrated in FIG. 11.

Figure 12:
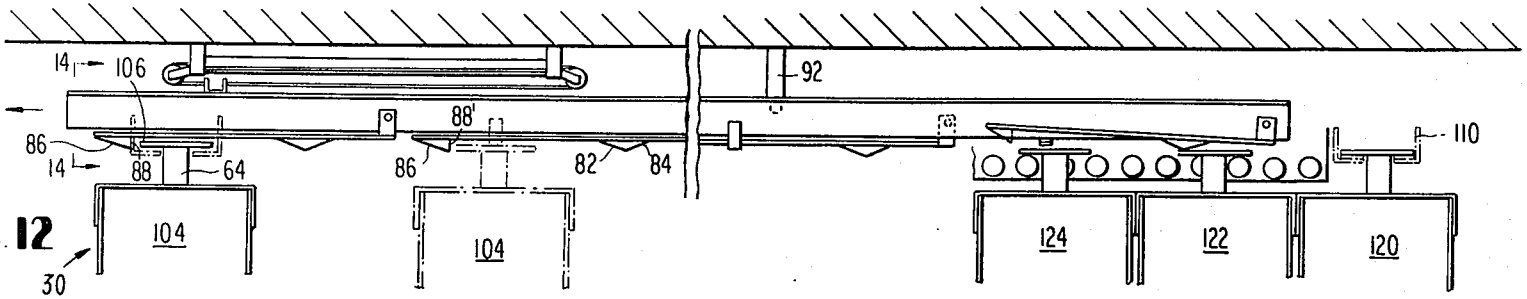
FIG. 12 is a side view, partly in section and with portions omitted, of an accumulation conveyor according to the present invention, taken along lines 12—12 of FIG. 11.

The conveyors used in accumulation areas 12, 16 are for the most part substantially identical, and are described with reference to FIGS. 12–14. As seen in FIGS. 11 and 12, the two accumulation conveyors 70 support the carriers by means of a plurality of independent rollers 60, arranged in pairs and supported by journals 62. As shown in FIG. 12, each carrier 30 is provided with the generally "T" or mushroom-shaped top 64 which may be suitably attached to the carrier frame by fasteners or by welding or the like. The top 66 of these "mushrooms" is flat on both sides and is generally square in shape.

A series of carriers is initially arranged in the accumulator area 12, suspended from the overhead conveyor. When a run is to be commenced, the conveyor 70 is actuated, the conveyor acting to line up the carriers in close proximity to each other, beginning in the area of the doorway area 14. An elevator 72 is arranged in this vicinity to aid personnel in loading the carriers with the produce to be irradiated.

The accumulating conveyor 70 consists of a pair of stationary parallel rails 74 which support the carriers and to which the journals 62 and rollers 60 are attached. Disposed above and between the stationary rails 74 is a movable T-shaped beam 76 which carries a plurality of cam-catch members 78. Each cam-catch member is pivotally mounted by a pivot pin 80 received within the body of T-beam 76, and is provided with three camming surfaces 82, 84, 86. The two camming surfaces 82, 84 are integral and form a bi-directional cam or double wedge structure, while the camming surface 86 forms a unidirectional cam having a catch or "puller" surface 88 formed at the right-hand end thereof as viewed in FIG. 12. The T-beam is also provided with a plurality of stop members 90, which limit the downward pivotal movement of the cam-catch members 78 about the pivot pins 80.

Figure 14:
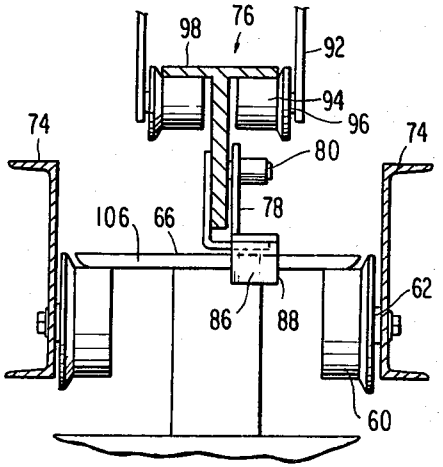
FIG. 14 is an end view of the conveyor of FIG. 12, taken along lines 14—14 of that figure.

The T-beam is supported for linear reciprocating movement by a plurality of brackets 92, one of which is shown in FIGS. 12 and 14. The brackets 92 carry a plurality of rollers 94 arranged in pairs and supported by journals 96. As seen in FIG. 14, the horizontal portion 98 of the T-beam 76 rides on and is guided by the rollers 94.

Disposed above the T-beam 76 is a horizontally mounted pneumatic cylinder 98 having a cable 100 attached at both ends to a bracket 102. The pneumatic cylinder is suitably connected to a source of pressurized air for causing the T-beam 76 to undergo reciprocating linear movement.

As previously noted, there are two accumulator conveyors 70, one in accumulation area 12 and one in accumulation area 16. The operation of these conveyors will now be described, in conjunction with FIGS. 11, 12, 13A, 13B and 14.

FIG. 11 schematically illustrates the two conveyors 70. It should be noted that each of these conveyors receives product carriers from a further conveyor operating in the transverse direction with respect thereto, and delivers these carriers to a still further transversely situated conveyor at the end thereof.

Figure 13A:
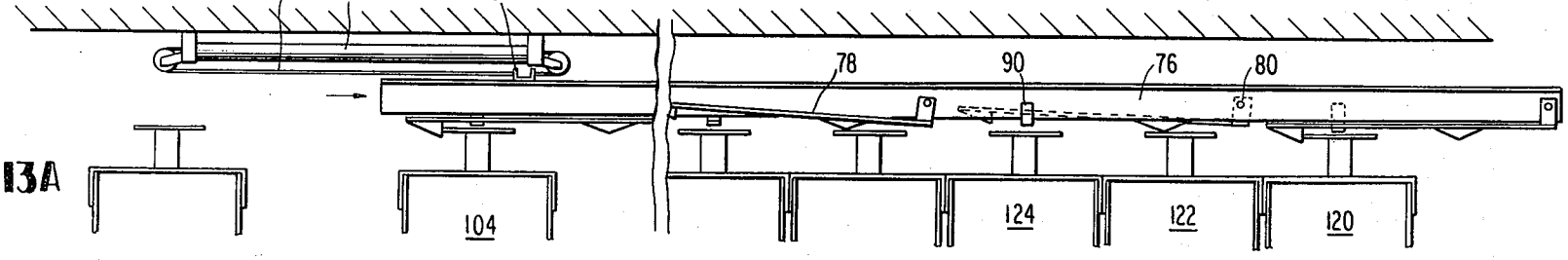
FIG. 13A is a side view, partly in section and with portions omitted, illustrating the operation of the conveyor of FIG. 12.
Figure 13B:
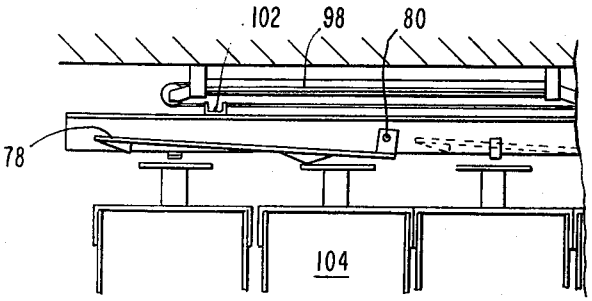
FIG. 13B is a further view of a portion of FIGS. 12 and 13A, illustrating further operation of the conveyor of FIG. 12.

In FIGS. 12, 13A and 13B, the direction of transport is from left to right. In FIG. 12, a carrier 104 is shown entering the receiving end of the conveyor. Under the control of the pneumatic cylinder 98, the T-beam 76 will be moved to the left, and cam surface 86 will engage the top of the mushroom 64. The T-beam will proceed leftwardly until the cam surface 86 slides over the top of the mushroom, simultaneously camming the cam-catch member 78 clockwise about its pivoting axis 80. When the T-beam has reached the position shown in FIG. 12, the cam surface 86 has completely passed over the mushroom, and the cam-catch member 78 has fallen counterclockwise under its own weight such that the catch surface 88 is in alignment with a side 106 of the top of the mushroom 64 of the carrier 104. This position is also shown in FIG. 14. The T-beam now moves rightwardly under the control of the pneumatic cylinder 98, the catch surface 88 engaging the mushroom 64 in order to transport the carrier 104 rightwardly while supported by the rollers 60. The carrier will be moved to the right a distance corresponding to the stroke of the pneumatic cylinder 98, whereupon the T-beam will return to its starting position to receive another carrier. During leftward travel of the T-beam, cam surfaces 82, 84 will ride up and over the mushroom 64 of the incrementally moved carrier 104, but the position of the carrier will not be affected thereby.

When the T-beam is in position to begin transport of another carrier, the incrementally moved carrier 104 will be in the position shown in FIGS. 12 (Phantom) and 13A, wherein a second catch surface 88' will be in a position where it will engage the mushroom 64 of the carrier 104 upon rightward movement by the T-beam. Thus, the carrier 104 will be transported a further increment of distance every time the T-beam goes back to pick up a further incoming carrier. In this regard, it should be noted that the stroke or linear displacement of the pneumatic cylinder is slightly greater than the distance between adjacent catch surfaces 88, 88'.

This process proceeds sequentially and eventually the first carrier will reach the end of the conveyor 70, whereupon it will be delivered to the entrance of a further, transverse conveyor 110. Since further carriers follow behind the first carrier, means must be provided whereby the subsequent carriers will be closely lined up behind the first carrier, without being driven into and damaging the same. This function is achieved via the co-action between the cams 82, 84, 86 and the mushroom tops, and the pivotability of the cam-catch members 78. Particularly, as seen in FIG. 13A, the T-beam is shown at the extent of its travel in the right-hand direction. In this position, a carrier 120 is shown as already situated at the entrance to the transverse conveyor 110, with further carriers 122, 124 arranged closely therebehind. The right most catch member 88 will have delivered the first carrier 120 to this position, and will have returned to pick up the next carrier 122. Upon the carrier 122 reaching the position shown, camming surface 84 will pivot the cam-catch members 78 clockwise, so as to release the engagement between catch 88 and the carrier 122, while T-beam 76 continues its rightward movement. It should be noted in this regard that the distance between adjacent closely packed carriers is such that the distances between surfaces 106 of adjacent carrier mushroom tops is slightly less than the distance between catch surface 88 and cam surface 84 of a single catch-cam member 78. Catch member 88 will then return leftwardly, the surface 86 camming over the mushroom of carrier 122, and subsequently catching the mushroom of carrier 124. Carrier 124 will be moved rightwardly to the position shown, whereupon cam surface 84 will engage the mushroom of carrier 122, releasing the engagement between catch 88 and carrier 124. The T-beam 76 will continue its rightward movement, but catch 88 will not again be operable due to the effect of cam 84 lifting the catch 88 upwardly out of alignment with the mushrooms of carriers 120–124, respectively.

This "stacking" process will continue until each of the catch members 88 in turn become inoperable. FIG. 13B illustrates the situation where the conveyor 70 is fully loaded, the first catch member at this point becoming inoperable. When the conveyor 70 is fully loaded in this manner, the conveyor 70 may be shut down, or it may be allowed to continue reciprocatory movements, having no effect on the position of the carriers.

The conveyor 70 will again become operable when the first carrier 120 is moved transversely down the further conveyor 110. At this time, the last in the series of catch members 88 will not be prevented from engaging the carrier 122, and each of the other carriers will be in turn moved forward an increment of one carrier width.

As noted in the particular configuration of FIG. 11, there are five additional conveyors or conveyor paths located external to the irradiation chamber in addition to the previously described accumulator conveyors 70. These other conveyors are substantially identical to one another, except as regards the length of the conveyor run. These conveyors are denoted by numerals 140, 142, 144, 146 and 148 in FIG. 11, and will be described with reference to FIGS. 15–18.

Figure 15:
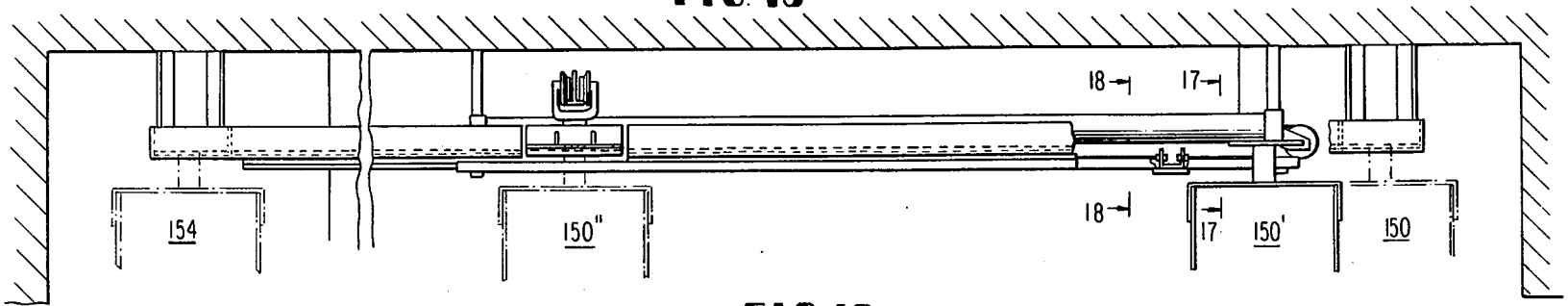
FIG. 15 is a view taken along lines 15—15 of FIG. 11, illustrating a further type of conveyor situated within the labyrinth.
Figure 16:
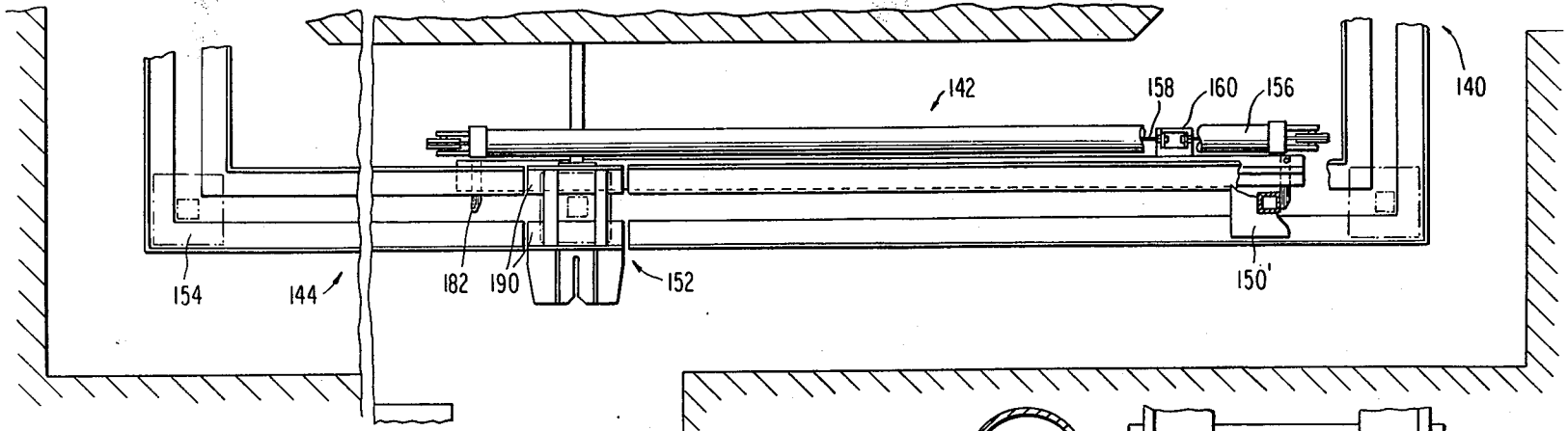
FIG. 16 is a top view of the conveyor of FIG. 15, illustrating the operation of this conveyor.
Figure 18:
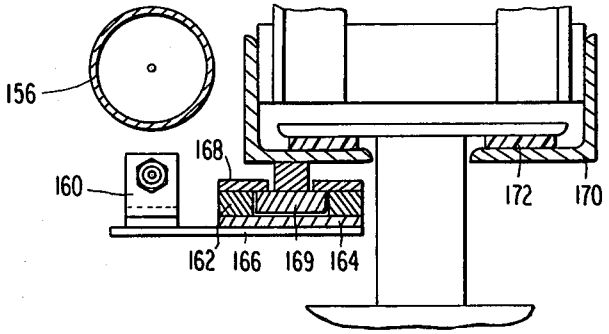
FIG. 18 is a further side cutaway view, taken along lines 18—18 of FIG. 15, of this conveyor.

FIGS. 15 and 16 illustrate a side and top view, respectively, of a pneumatically operated conveyor designed to transport carriers linearly along a unidirectional path. The construction of FIGS. 15–18 relates specifically to the conveyor 142 illustrated schematically in FIG. 11, but it is understood that all conveyors 140–148 operate substantially identically.

In FIGS. 15 and 16, a carrier 150 is shown at a position corresponding to the end of the conveyor 140 and the beginning of the conveyor 142. This latter conveyor will transport the loaded carrier from this point to a shuttle 152, which will be described in more detail later, and will subsequently be operable to transport a carrier from the shuttle to the position 154. The conveyor 142 includes a stationary horizontally disposed pneumatic cylinder 156 having a drive cable 158 connected at both ends to a bracket 160. The bracket is in turn connected to a slide 162, as most clearly seen in FIG. 18. The slide 162 is generally cup-shaped in cross-section and is provided with a bottom 164 suitably secured to a connecting member 166 which bridges the distance between the slide 162 and the bracket 160. Atop the slide 162 are affixed two parallel bars 168 which partially enclose the cup-like opening and retain therein a T-shaped rail 169 provided integrally along the bottom of carrier guide rails 170. The guide rails 170 slidably support the weight of the carrier during its travel, and are provided with bearing pads 172 of nylon or other suitable bearing materials to lower the friction between the carrier mushroom and the guide rails.

As seen in FIGS. 15 and 16, the slide 162 extends horizontally for some distance beyond the position of the bracket 160, thus allowing the end of the slide to extend beyond the end of the pneumatic cylinder 156 in the rightward direction. The end of the slide is provided with means for engaging the carrier mushroom, such that the carrier will be moved along with the slide in the leftward direction in FIG. 15.

Figure 17:
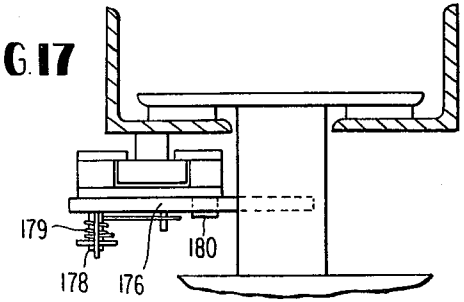
FIG. 17 is a side cutaway view of the conveyor of FIG. 15, further illustrating the operation of the same, and taken along lines 17—17 of FIG. 15.

This engaging means is most clearly seen in FIG. 17, and takes the form of a pivotable dog 176 connected to the bottom of the slide 162 by means of a pivot pin 178. The dog 176 is biased by torsion spring 179 into the position shown in FIGS. 16 and 17, at a right angle with respect to the slide 162. A stop 180 is fixed to the underside of the slide 162 to limit the pivotal movement of the dog 176 to the right angle position.

In operation, the conveyor 142 functions as follows. When a carrier reaches the position occupied by carrier 150 in FIG. 15, the pneumatic cylinder 156 will be operable to move slide 162 rightwardly, carrying the dog 176 therewith. During this travel, the dog 176 will engage the "stalk" of the mushroom of the carrier, and will pivot clockwise in order to allow the slide to pass the mushroom. Once the end of the dog has passed by the stalk, it will pivot counterclockwise under the force of torsion spring 179 to a position at right angle with respect to the slide 162, where the stop 180 will prevent further counterclockwise movement. When the slide moves leftwardly under the control of the pneumatic cylinder, the dog will engage the rear side of the stalk and transport the carrier leftwardly, with the mushroom thereof sliding along bearing pads 172. This engagement is also shown in FIGS. 15 and 16, wherein numeral 150′ denotes the position of a carrier after the beginning of transport.

In this manner, the carrier will be conveyed to the position denoted by numeral 150″, i.e. onto the shuttle 152. Let us assume for this moment that the shuttle 152 is not to be operated, and it is desired to further transport the carrier to the position 154. In this case, it should be noted that the slide 162 is provided with a second dog 182 at the left hand side thereof. Thus, when the first dog 176 returns to its starting position to pick up another carrier, the second dog 182 will become engaged with the backside of the stalk of the carrier located on the shuttle 152. Thus, while the first dog transports a further carrier to the shuttle, the second dog transports the first carrier to the position 154. It should be noted that the conveyor 142 is not intended to be operated in this manner. However, the conveyors 140,146 which have no shuttle arranged therein, do in fact operate as just described.

The short conveyor 148 functions in substantially this manner, but is provided with additional safety features to prevent unauthorized entry into the labyrinth passageways. In particular, a pair of doors 188, 188′ are provided between the carrier loading area and the accumulation area 16 (FIGS. 1, 11). The space between these doors will accommodate a single carrier, but little else. When the accumulator conveyor 70 in the accumulation area 12 delivers a carrier to the input of the conveyor 148, the first door 188 will open while the second door 188′ remains closed. The first dog of the conveyor 148 will transport the carrier to the position between the doors, after which the first door is closed and second door is opened. The second dog then transports the carrier to the accumulator conveyor 70 in accumulation area 16. It should be noted that the sequencing of conveyors 148, 70 under the control of a controller 199 is such that when the second dog moves into position to transport the carrier through the open second door, the first dog does not engage a further carrier, as the conveyor 70 will not have transported a further carrier to the input of conveyor 148 by this time. Thus, only one carrier at a time is transported by the conveyor 148, and the double door interlock system prevents any chance of unauthorized entry into the accumulation area 16, or into the irradiation cell itself.

As noted, the purpose of the external conveyor systems is to deliver carriers to the irradiation cell, and to unload carriers from the cell for delivery to a product unloading station. Of course, the "delivery" conveyors and the "unloading" conveyors may be operated at the same time when it is desired to load the cell with a new set of carriers while unloading exposed carriers. This operation will be discussed in more detail in the discussion of the loading mode, infra. The device responsible for the loading and unloading of the cell is the carrier shuttle 152, described below.

Carrier Shuttle

As just mentioned, the purpose of the shuttle is to move carriers into and out of the irradiation chamber 10. However, in addition to this function, the shuttle 152 is also operable to cause the transposition of the carriers upon a given carrier supporting rack 220. When the number of carriers on each rack 220 is two or more, the right-most carrier on each rack will be moved off the rack onto the shuttle, which will then retract while the rack moves from one side of the chamber 10 to the other. The removed carrier will then be replaced on the same rack, such that it is now the left-most carrier on this rack.

Returning now briefly to FIGS. 1 and 16, the shuttle 152 is shown in a position where it is operable to receive a carrier from the conveyor 142. In FIG. 16, it is seen that the shuttle is provided with a pair of rails 190 in alignment with the rails 170 of the conveyor 142 such that the first dog 176 of the conveyor 142 accurately positions the carrier onto the shuttle. As particularly seen in FIG. 1, the shuttle 152 is mounted at the end of a long extension pole 191 driven by a pneumatic cylinder 192, the pole 191 being of a length sufficient to allow the shuttle to traverse a substantial distance into the chamber or cell 10.

Figure 4:
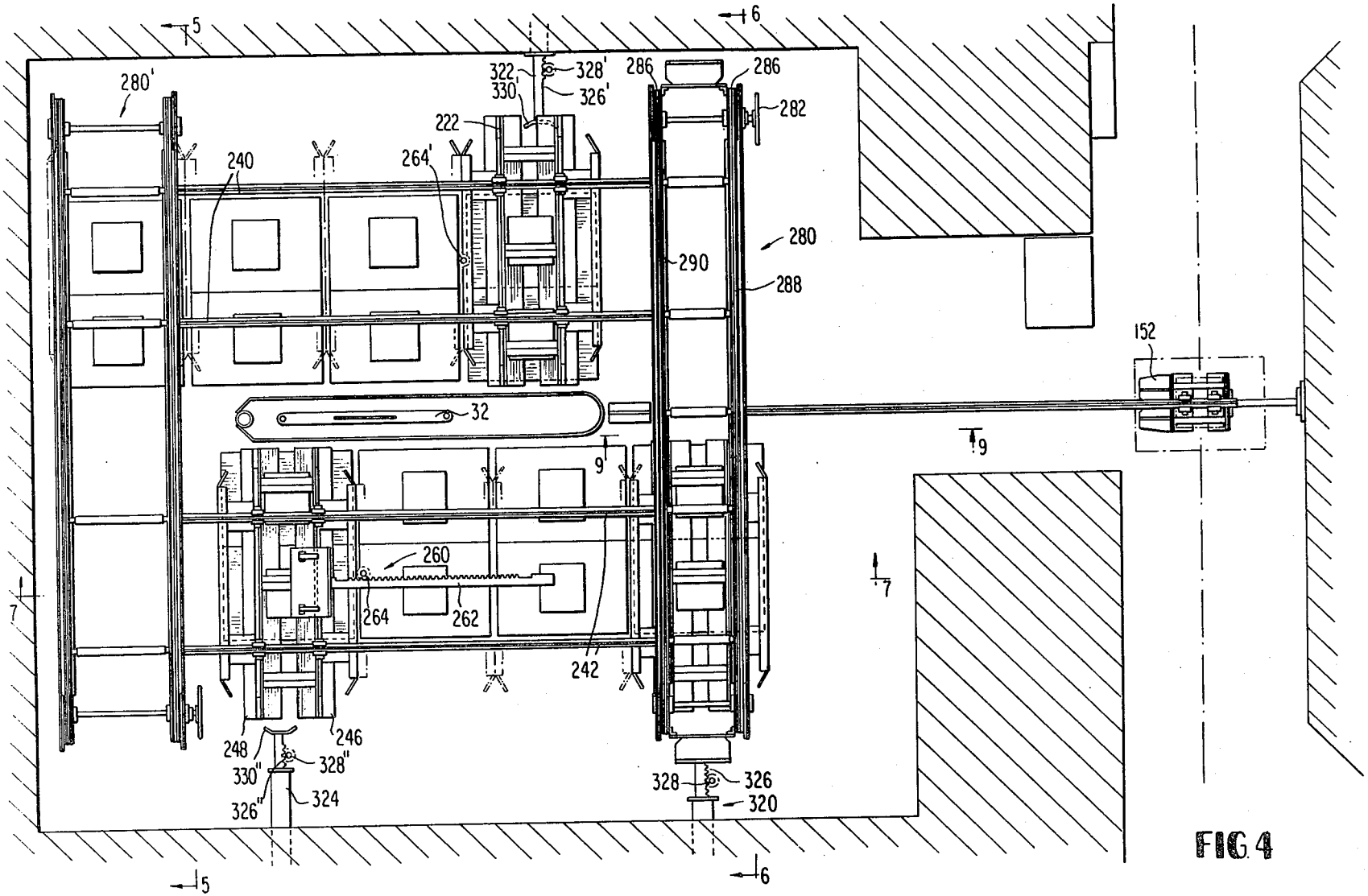
FIG. 4, is a top view illustrating the conveyor mechanisms located within the radiation chamber, and part of the labyrinth.

In FIG. 4 the shuttle is shown with a carrier (In Phantom) depending therefrom, ready to be transported into the irradiation chamber. In the right-hand side of FIG. 7, the shuttle is shown approaching the conveyor mechanism within the cell 10 itself. In this view, the rails 190 supporting the carrier are visible, as is one of a pair of transverse bars 196 suitably connecting the two rails together. A pair of rollers 200 are suitably attached to each of the bars 196 by means of brackets 198, these rollers being engaged with the horizontal portion 202 of an inverted T-beam 204, so as to support the weight of the carrier as the pole 191 extends into the cell 10.

Figure 9:
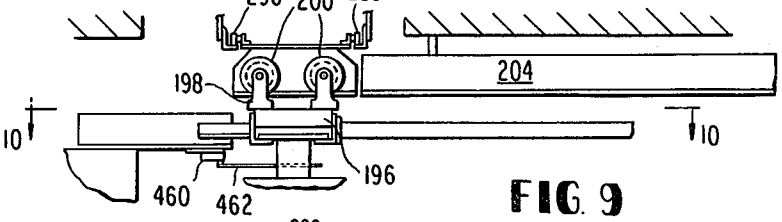
FIG. 9 is a view of another portion of the apparatus of FIG. 7, illustrating the operation of the shuttle conveyor mechanism.
Figure 10:
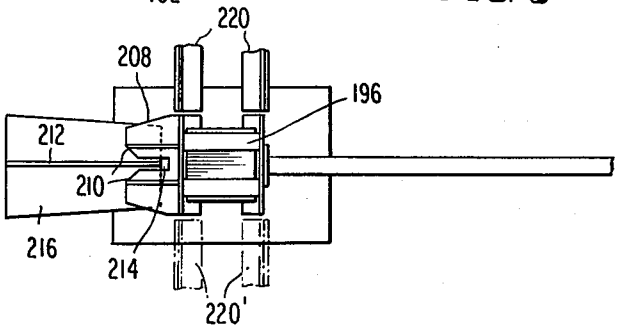
FIG. 10 is a top cutaway view of the shuttle mechanism, taken along lines 10—10 of FIG. 9.

FIGS. 9 and 10 illustrate the position of the shuttle 152 at the extent of its travel into the cell 10. As seen in these figures, the shuttle is provided with a forward facing alignment plate 208 having cam surfaces 210 and an alignment slot 214. In the position shown, a vertical plate 212 of an inverted T-shaped member 216 will be inserted into the slot 214, so as to properly align the shuttle with the plate 212, and prevent lateral movement of the shuttle 152 in the steps that follow.

Irradiation Cell Conveyor System

As further seen in FIG. 10, the shuttle 152 in its end position has its rails 190 in alignment with a further pair of rails 220 of an overhead carrier rack generally designated at 222 (FIG. 4). The carrier will be loaded onto the carrier rack 222 by means of a shuffler loader 320 (FIG. 6) whose operation will be described later. During the operation of loading the carriers onto the overhead carrier racks, the shuffler 320 will always push a carrier from the shuttle onto the rails 220 of an adjacent rack 222. A second pair of rails 220′ of another rack is shown in phantom in FIG. 10. These rails will be in this position when a carrier is to be unloaded from the rails 220′ onto the shuttle 152, to exit the cell.

As seen in FIG. 4, there are a total of 8 carrier racks 222, each of which can accommodate a pair or more of carriers. Not all of the racks 222 are depicted in FIG. 4, for purposes of clarity. Each individual rack 222 is provided with a pair of rails 220, as noted previously, and a number of transverse bars or rails 228 connect the rails 220 in suitable manner. If desired, the rails 220 may be provided with bearing pads 230 in order to reduce friction between the mushroom and the rails. Secured to the vertical flanges 231 of the rails 220 are two pairs of brackets 232, 234 which house rollers 236, 238, which are rollable along parallel tracks 240, 242 supported from the ceiling of the cell 10.

Each rack 222 is also provided with tubular members 246, 248 attached to the backsides of the rail flanges 231. The tubular members are in turn attached to fenders 250, 252, such that the fender 252 of one rack 222 will abut the fender 250 of an adjacent rack 222 when the racks are closely packed. The width of a carrier is very slightly less than the distance between the ends of fenders 250, 252, such that the carriers may be arranged within the cell with a minimal clearance therebetween. The clearance between adjacent carriers has been exaggerated in FIGS. 4 and 7 for reasons of clarity.

Figure 7:
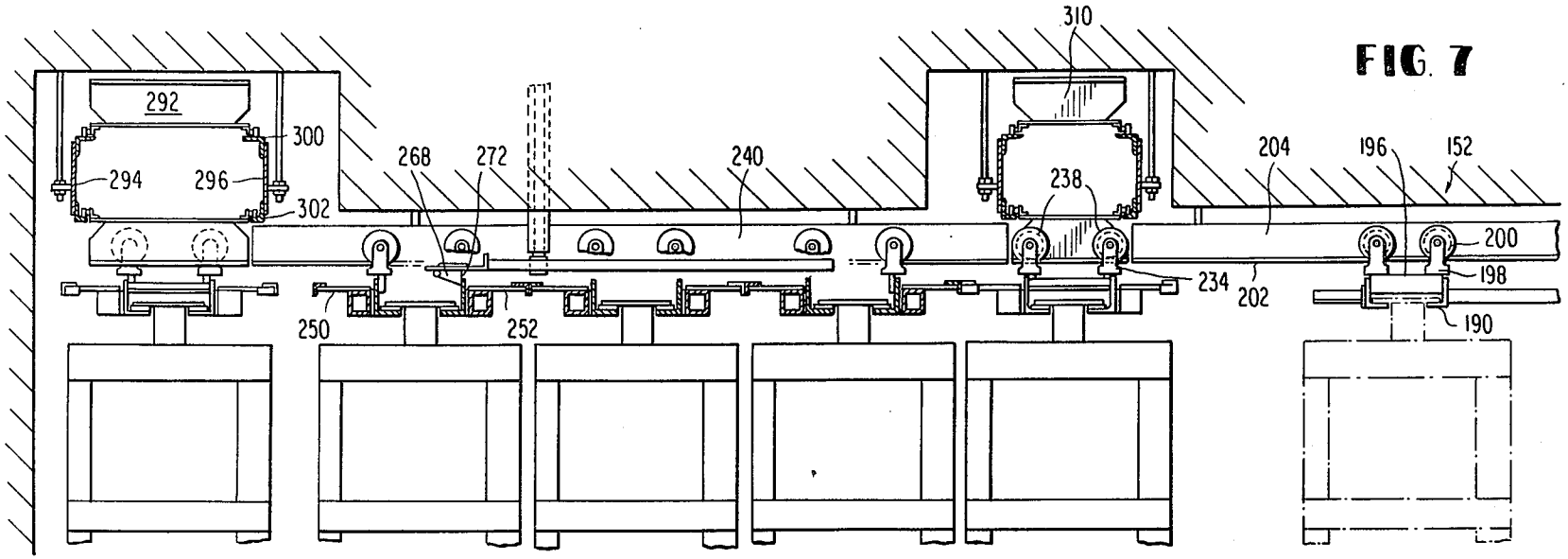
FIG. 7, illustrates further the operation of the apperatus of FIG. 4 on a side elevational view taken along lines 7—7 of FIG. 4.
Figure 8:
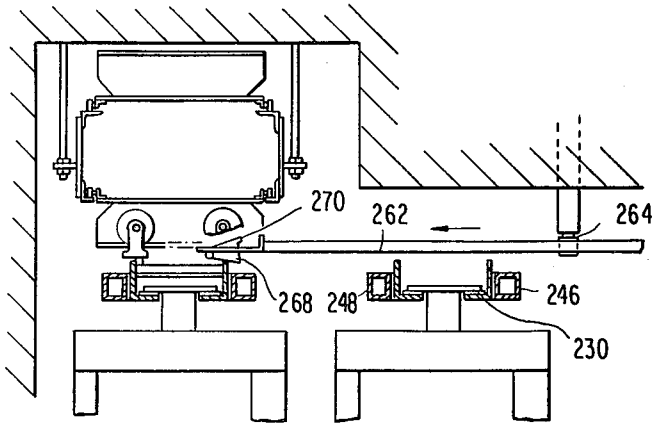
FIG. 8 is a further view of a portion of the apparatus of FIG. 7, illustrating the operation of one of the conveyor mechanisms within the radiation chamber.

As noted above, the racks 222 are supported by the rails 240, 242 as they move parallel to the source 32. The means by which the racks are moved in this manner is depicted in FIGS. 4, 7 and 8, and includes overhead rack and pinion "rake" mechanisms 260, 260', only one of which is shown in detail in the drawings. In FIG. 7, a toothed rack 262 is disposed in parallel with and between the rails 242, and is operatively engaged with a pinion 264. The toothed rack may be supported and guided in its movement by suitable guide or channel means (not shown). At the end of the toothed rack is a plate 266 having a pair of pivotally mounted unidirectional cams 268. As seen in FIG. 8, when the toothed rack 262 is driven to the left by pinion 264, the cams 268 will ride up and over the flange 231 of the left rail 220 of the leftmost rack 222, and will then fall down under their own weight to a position where the vertical "puller" faces 272 thereof engage the inside surface of the flange 231. The cams are provided with stops 270 to limit the downward pivotal movement thereof.

The pinion is now driven in the forward direction, moving the toothed rack 262 to the left as viewed in FIG. 8, to the end position shown in FIG. 7. In the process, the three carrier racks 222 in front of the rack being pulled by the cams 268 are likewise moved forwardly, due to the engagement between adjacent rack fenders 250, 252.

As noted previously, only one of the rack and pinion members are shown in the drawings. It will be understood that an identical rack and pinion arrangement is disposed in the upper half of FIG. 4, the pinion 264' of the further rack and pinion being shown so that the placement of the rack member will be readily understood.

As stated above, the conveyor systems disposed within the cell 10 are designed to transport the several carriers in a generally rectangular path about the source 32. The means of transport in the direction parallel to the source has been described above with reference to rack and pinion driving means 260. To complete the generally rectangular motion, means must be provided whereby the carriers are transported transversely with respect to the direction of displacement of the rack and pinion mechanisms 260. These means take the form of a pair of paddle conveyors in the present embodiment, which will be described with reference to FIGS. 4–6.

Figure 5:
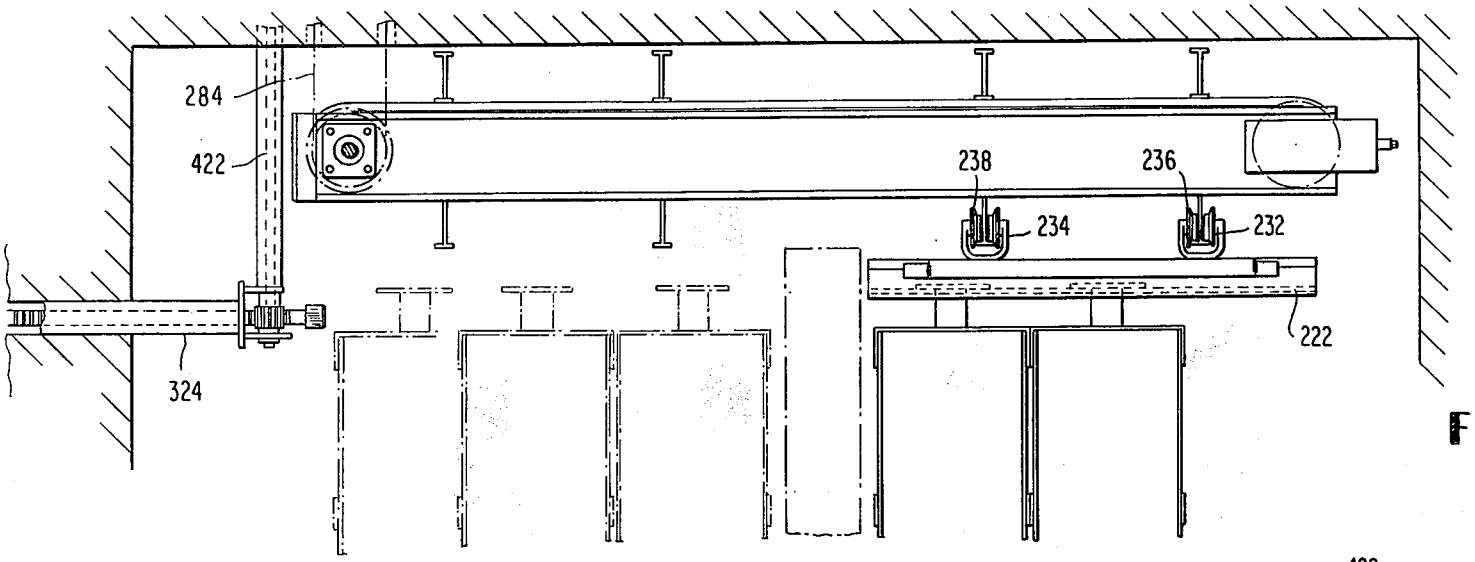
FIG. 5 is a side sectional cutaway view, partly in phantom, taken along lines 5—5 of FIG. 4.
Figure 6:
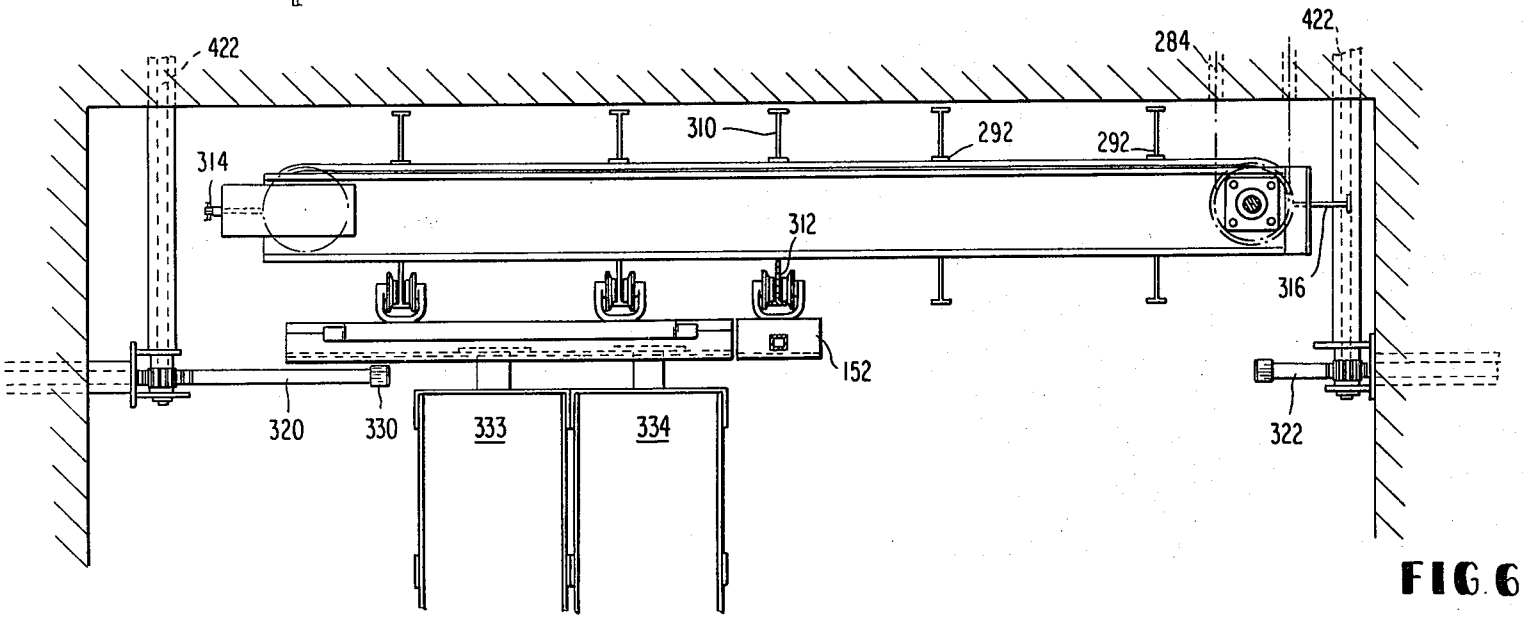
FIG. 6 is a further side view of the apparatus of FIG. 4, taken along lines 6—6.

FIG. 4 illustrates the placement and mode of operation of the front and rear paddle conveyors 280, 280' which, as seen, are arranged perpendicular to and closely adjacent the two pairs of carrier rack supporting rails 240, 242. The paddle conveyors are suitably supported from the walls or ceiling of the cell 10, and are chain driven by means of a sprocket wheel 282 and chain 284 in a conventional manner. The sprocket wheel 282 is rotatably attached to a pair of further sprockets 286 (FIG. 4) which drive a pair of chains 288, 290. These chains are suitably connected to a number of paddles 292 as seen in FIGS. 5 and 6 arranged at suitable intervals of distance. As seen in FIG. 7, the paddle conveyor has a pair of side walls 294, 296, each of which is provided with upper and lower L-shaped metal bars 300, 302 attached thereto. In the lower run of the conveyor, the chains 288, 290 are supported by the bars 302, which in turn support the weight of the paddles and the load attached thereto. In the upper run of the conveyor, the chain is guided over the top surfaces of the bars 300.

The paddles 292, as seen in FIGS. 5 and 6, are I-shaped in cross-section, the vertically and horizontally extending portions of the "I" having the same dimensions as the parallel rails 240, 242. Thus, when it is desired to transport the carriers from one side of the source 32 to the other, a pair of the paddles 292 are brought into alignment with the rails, and a carrier rack 222 is rolled onto the paddles from the rails. Suitable stops are provided to prevent the rack from rolling off the rails during the loading and subsequent transport of the same. One carrier rack 222 is shown in position on the paddles in the lower right of FIG. 4, the rack having reached this position due to the pushing force exerted by rack and pinion member 260, via the intermediate racks 222.

The paddle conveyor will now transport the rack 222, and the carriers depending therefrom, from one side of the source to the other, whereupon the paddles will align with the other pair of rails 240. It should be noted that the spacing of the paddles on the chains 288, 290 is such that when one pair of paddles is in alignment with the rails 242, another pair will be aligned with the rails 240.

The rack 222 thus transported will now be removed from the paddles onto the rails 240 by means of the rack and pinion mechanism 260'. Of course, before this can occur, a corresponding carrier rack must be removed from the rails 240 onto the paddles of the rear paddle conveyor 280', and this conveyor must be operated to transport the corresponding rack 222 to a position in alignment with the rails 242. Most efficiently, the two paddle conveyors 280, 280' are operated simultaneously, as are the two rack and pinion mechanisms 260, 260'. However, sequential operation of the four devices is permitted. For example, from the position shown in FIG. 4, the conveyor 280 may be actuated first, followed by actuation of the conveyor 280'. Then the rack and pinion mechanisms 260', 260 may be operated, respectively, to return the locations of the various members to the positions shown in FIG. 4.

It should be noted that when the rack 222 is positioned on the paddle conveyor, before it is moved onto the rails 240, 242, the carriers supported by this rack are at their greatest distance from the source in both the longitudinal and lateral directions.

It is important that the lateral distance between the carriers and the source be minimized as quickly as possible, and thus means are arranged within the cell for packing the carriers against one another and closely proximate the source as soon as the rack 222 supporting these carriers has been removed from the paddle conveyor onto the rails 240, 242. These means take the form of packer members 322, 324 in the present embodiment, the structure and operation of which are discussed below.

Figure 19:
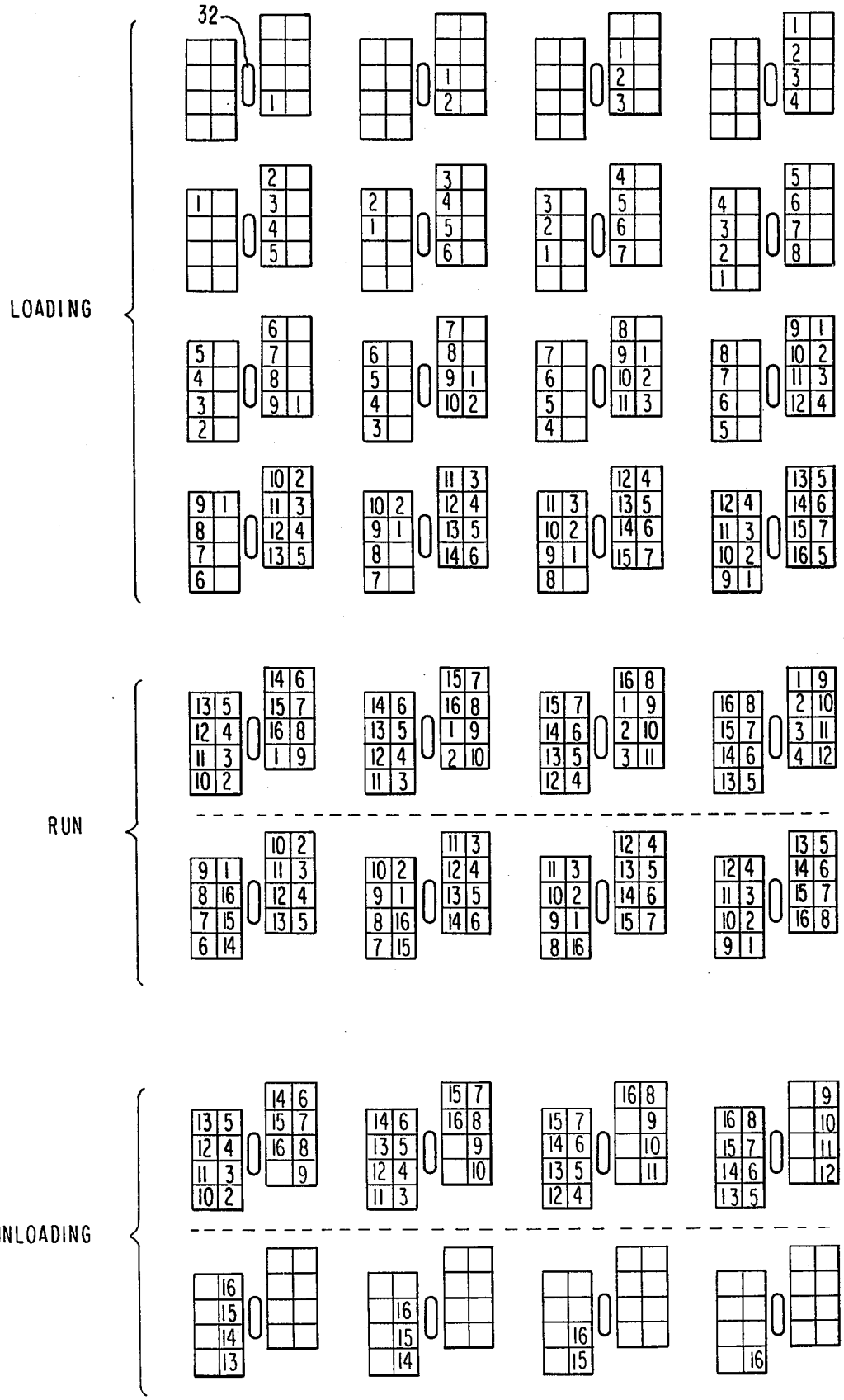
FIG. 19 is a schematic illustration depicting the sequential operation of the several cooperating conveyor mechanisms of FIG. 4, in the loading, unloading and run modes.

In FIG. 6, which shows a side view of the conveyor 280, it should be noted that paddles 310, 312, 314, 316 are provided at shorter intervals from adjacent paddles than are the paddles 292. The latter are used for transporting racks 222 as described above. However, the former paddles are provided as support for the shuttle 152, as seen in FIGS. 19 and 10, during the final portion of the travel of the shuttle into the cell 10. As seen in this Figure, the shuttle 152 is driven from the beam 204 onto one of these paddles while the front portion of the shuttle registers with the vertical plate 212 via aperture or slot 214. The shuttle is supported by this paddle in much the same manner as the racks 222 are supported by the paddles 292.

Turning again to the operation of the shuffler loader 320 and the front and rear packers 322, 324, each of these devices includes a toothed rack 326, 326', 326'' driven by a pinion 328, 328', 328''. At the outer end of each rack is provided an engagement member 330, 330', 330'' of angular shape. The purpose of the shuffler 320 is to displace a carrier from a carrier rack 222 to the shuttle 152, or from the shuttle to a rack. On the other hand, the packers 322, 324 are operable to precisely position a carrier or carriers on a rack 222. Each of the shuffler and packers operate by engaging the stalk of a carrier mushroom with its respective engagement member, and then pushing the carrier into the desired position. For example, FIG. 6 shows the shuffler 320 approaching a carrier 333. The shuffler, in this figure, will load the carrier 334 onto the shuttle 152 for unloading from the cell 10 through the intermediary of the carrier 333. During loading of the cell 10 with carriers, the shuttle 152 will periodically be in the position shown in FIG. 10, and the carrier held thereon will be transferred to the rails 220 of a carrier rack 222 by the shuffler 320. It should be noted that the rails 220', belonging to a further carrier 222 are shown in phantom in FIG. 10 because they will not be in the position shown when the shuttle-carrier rack transfer takes place. On the other hand, when a carrier rack-shuttle transfer is to be effected, the rails 220' will be in the position shown and the rails 220 will be situated off to the left of the position shown in FIG. 10. This position is also shown in FIG. 6.

The overall operation of the irradiation chamber carrier conveyance system will now be described, with reference to FIGS. 4–10, 16 and 19 of the drawings. The sequence of operation of the conveyor system is somewhat different, depending on whether the system is operated in the Loading, Run, or Unloading mode. Thus, the operation will be described in each of these modes, in succession for batch operation of the system.

Loading Mode

With reference first to FIG. 16, a carrier, which will be assumed to be the first such carrier 1, is placed on the shuttle by operation of the conveyor 142. The shuttle will then operate to deliver this carrier into the irradiation chamber, and the shuttle will be locked against transverse displacement by cooperation between the slot 214 and the alignment plate 212, and will be resting upon the paddle 312. The shuffler 320 will now be driven toward the carrier 1, and will engage the same at the stalk thereof, and will position the carrier on the adjoining carrier rack 222, resting upon rails 220.

The rack 222 will now be driven rearwardly a short distance by the rack and pinion mechanism 260', which has moved forward into a position such that the rack 222 supporting the first carrier 1 is engaged by the vertical puller surfaces of the cams 268 thereof. This "short distance" referred to corresponds to a position wherein the engagement member 330' of the packer 322 is in alignment with the stalk of the mushroom of the carrier 1. The packer 322 will then position the carrier 1 as desired on the rack 222.

The rack and pinion mechanism 260' then operates again to move the carrier rack 222 forward slightly, again pushing along further racks 222 in the process such that a rear rack 222 is now in position on the paddle conveyor 280'. In the meantime, the rack and pinion mechanism 260 on the other side of the cell has moved the racks 222 on this side of the cell to their forward positions, as shown in the lower half of FIG. 4.

The overall configuration at this point is seen in FIG. 4, and schematically in the first illustration of FIG. 19. The paddle conveyors 280, 280' now operate to transfer two racks 222 from one side of the source to the other such that the configuration of elements resumes its original position. The rack and pinion mechanisms 260, 260' operate to engage the transferred racks 222 via the cams 268, and a carrier 2 will enter the cell via the shuttle.

As seen in FIG. 19, this process is continued without change until the first diagram in the second row. At this point, the packer 324 becomes operable to readjust the position of the carrier 1 upon its rack 222, and the same applies to successive carriers 2, 3 . . . etc. The reader will note that several intermediate steps have been left out between successive diagrams in FIG. 19 for purposes of clarity.

Beginning with the third row of diagrams in FIG. 19, two carriers are placed on each rack 222, beginning with carrier 9. When the carrier 9 is pushed from the shuttle 152 onto the rack 222 by the shuffler 320, it may shove carrier 1 over to a certain extent to make room for itself. After the rack and pinion 260' has moved this rack 222 rearwardly a short distance, the packer 322 will operate to pack the carriers in abutting relationship with one another, with the carrier 9 being spaced from the source 32 by as small a distance as practicable. The position of the two carriers 1 and 9 after such positional adjustment is seen in the right-hand side of FIG. 5, where the clearance between the carrier 9 and the cage or frame surrounding the source has been exaggerated. The source, of course, is not in the "up" position during the Loading mode, but the clearance between the carriers and the source will be maintained at this small value when the Run mode is executed also.

The process will continue until each rack is loaded with two carriers as seen in the last diagram in the fourth row of FIG. 19. Of course, upon reaching the position shown in the first diagram of the third row, the packer 324 will operate to reposition the carriers 9, 1 such that carrier 1 is now closely proximate the source cage, in the same manner as carrier 9 was previously. In the left-hand side of FIG. 5, the carriers 10, 2 (behind 9, 1) are shown just before the operation of the packer 324 as just described.

The above operation is equally applicable in the situation where carriers are being loaded into, and removed from, the cell at the same time. In particular, referring to the last diagram illustrating the loading operation in FIG. 19, and the first diagram illustrating the unloading mode in the same figure, the carrier 1 may be removed from the cell by operation of the shuttle, after which the rack supporting the remaining carrier 9 is moved from one side of the cell to the other. Then, the shuttle may operate to bring a new carrier 17 into the cell before removing the carrier 2. The new carrier 17 will, of course, occupy the empty space illustrated adjacent carrier 9 in the first diagram of the unloading mode in FIG. 19.

When the cell is fully loaded, the source is raised from its position at the bottom of the pool by remote control via the pneumatic cylinder 44, and the Run mode is commenced.

Run Mode

In the Run mode, the sequence of operation is fundamentally the same as in the Loading mode. The changes which are made have the purpose of ensuring that each of the carriers 1–16 receive the same radiation dose over a complete cycle of operation. For instance, if the sequence of operation of the Loading mode were merely continued in the Run mode, it is clear that the carrier 16, for instance, would travel close to the source on the right-hand side of the radiation cell, and then relatively far from the source on the left-hand side of the cell. At the end of a single pass around the source, each carrier 1–16 would have received the same amount of radiation, but not a uniform dose. That is, the left-hand side of the carrier 16 would have received several times the amount of radiation that the right-hand side had received.

In order to uniformly radiate the product within the carriers, the shuttle operates during the Run mode to transpose the carriers as they travel from one side of the cell to the other at the start of each pass. For example, between the last diagram of row four of FIG. 19 and the first diagram of row five, the shuffler 320 operates to engage the carrier 9, thus pushing the carrier 1 onto the waiting shuttle. FIG. 6 shows the positions of the carriers and the shuttle just before this occurs. Once the carrier 1 is situated on the shuttle, the shuttle retracts backwardly toward the exit of the cell, and the carrier rack 222 is transported from one side of the cell to the other, via paddle conveyor 280. Then the shuttle returns to the cell, and the shuffler again operates to push the carrier 1 onto the rack 222 with the carrier 9 thereon. This process continues with the carriers 10, 2; 11, 3 . . . , etc. each pair of carriers being transposed in turn. The sequential operation of the remaining elements occurs substantially as described above with respect to the loading mode. It is important to note, however, the during the Run mode the packers 322, 324 operate to maintain the carriers in positions as close to the source as possible, such that the utilization efficiency of the radiation is maintained as high as possible. Given the additional fact that the carriers on either side of the cell are spaced from one another with a minimum of clearance, the overall efficiency of the operation can be maximized.

When the irradiator is operated in a continuous mode, new carriers enter the cell and as exposed carriers exit the cell, the Run mode serves also to load and unload the irradiator and shift the carriers. In such event, carrier 17 (not shown) would replace carrier 1 after it has completed two passes; carrier 18 (not shown) would replace carrier 2, etc.; and if there were two complete sets of carriers, carrier 1 would eventually replace carrier 17, and so on in a continuous cycle.

Returning to the batch mode in the Run cycle of FIG. 19, several intermediate rows of diagrams have been omitted, but it should be readily understood that when the configuration reaches the position shown at the end of the Run cycle, each of the carriers 1–16 has received an equal dose of radiation, and that the radiation has been uniformly applied to both the right- and left-hand sides of each carrier in both the first and second file.

Although the run and loading modes have been described above with reference to the situation where only two carriers are supported on a given rack, it can easily be seen that the process is equally applicable when three or more carriers are supported on each rack. When there are but two carriers on each rack, each carrier will have been in each of the 16 positions by the time two traversals of the source are completed. However, in the case of three or more carriers, it will require X traversals of the source before each carrier has assumed each of the available positions, where X is the number of carriers supported on each rack.

Unloading Mode

When the Run cycle is ended, the carrier 1–16 will be arranged in the position shown in the last diagram of row six of FIG. 19. Assuming that a further Run cycle is not desired, the source is lowered, the radiation cell unloaded, and the carriers returned to their starting positions so that the product carried thereon can be removed. It is desired in the unloading process to remove the carriers in the same sequence in which they were loaded into the cell, so that it will be easy to keep track of the location of the carriers and the products thereon, which may differ from carrier to carrier.

From the last diagram illustrating the Run mode in FIG. 19 to the first diagram illustrating the Unloading mode, the carriers 9 and 1 have been pushed leftwardly by the shuffler 320 to an extent such that carrier 1 is transported into position on the shuttle 152, and the shuttle has carried this carrier out of the cell. Subsequently, the carrier rack 222 has been conveyed from the left-hand side of the cell to the right-hand side by the paddle conveyor 280, carrying with it the remaining carrier 9. The carrier 9 will be on the right-hand side of the rack 222 due to the operation of the shuffler 320 when the carrier 1 was pushed onto the shuttle by the intermediary of the carrier 9.

The rack and pinion mechanisms 260, 260' then operate to transport the right-hand racks 222 backwardly and the left-hand racks forwardly, after, of course, the carriers 13, 5 are moved from the right to the left side of the cell. There is no need to operate the packers 322, 324 during the unloading operation, as precise positioning of the carriers on the racks is relatively unimportant here. The configuration now assumes that of the first diagram illustrating the Unloading mode in FIG. 19. As can be seen, the carrier 2 is now in a position where it will be next removed from the cell. The process continues in this manner, as shown in subsequent diagrams in FIG. 19, where two rows of diagrams have been deleted to avoid redundancy, until all of the carriers 1–16, have been removed from the cell.

In the illustration provided, the cell is empty after carrier 16 has been removed from the cell. However, it is readily apparent that, in batch operation as in continuous operation, the cell could be refilled as it is unloaded, carrier 17 replacing carrier 1, etc. until new carriers 17 through 32 (not shown) are in the cell.

As each carrier leaves the cell on the shuttle 152, it should be obvious that the external conveyor systems are operable to transport the carriers back around to the accumulator conveyor 70 to be unloaded, via conveyors 144 and 146. As mentioned previously, the second dog 182 (FIG. 16) operated by pneumatic cylinder 156 is operable to transport the exiting carriers from the shuttle 152 to the position 154 via conveyor path 144. From there, the conveyor 146 transports the carriers to the input of accumulator conveyor 70 in an identical fashion.

Conveyor Drive System

The operation of the internal or cell conveyor systems has been discussed above. The means by which these systems operate in the manner described will now be discussed, with particular reference to FIGS. 2 and 3. In FIG. 2, numeral 400 refers to an equipment room situated above the irradiation cell. In this room are situated the drive means which operate the various conveyor systems within the cell. The equipment room is separated from the cell by several feet of concrete, which may be suitably reinforced in order to provide a radiation barrier between the two rooms. The paddle conveyors 280, 280'; packers 352, 354; shuffler 320; and rack and pinion mechanisms 260, 260' are all driven by separate electric motors situated within room 400, the drive being transferred from the room 400 to the cell by means of shafts or chains extending through the concrete floor to the particular elements to be driven. The source itself is driven by a pneumatic cylinder 44 within the room 400, as was described previously.

While it is possible to drive the several conveyor systems using motors and microswitches disposed within the chamber 10 itself, it is desired to remove such devices from the cell to the greatest extent possible, because the high radiation levels within the chamber have been found to cause premature breakdown of such electrically controlled devices.

Figure 3:
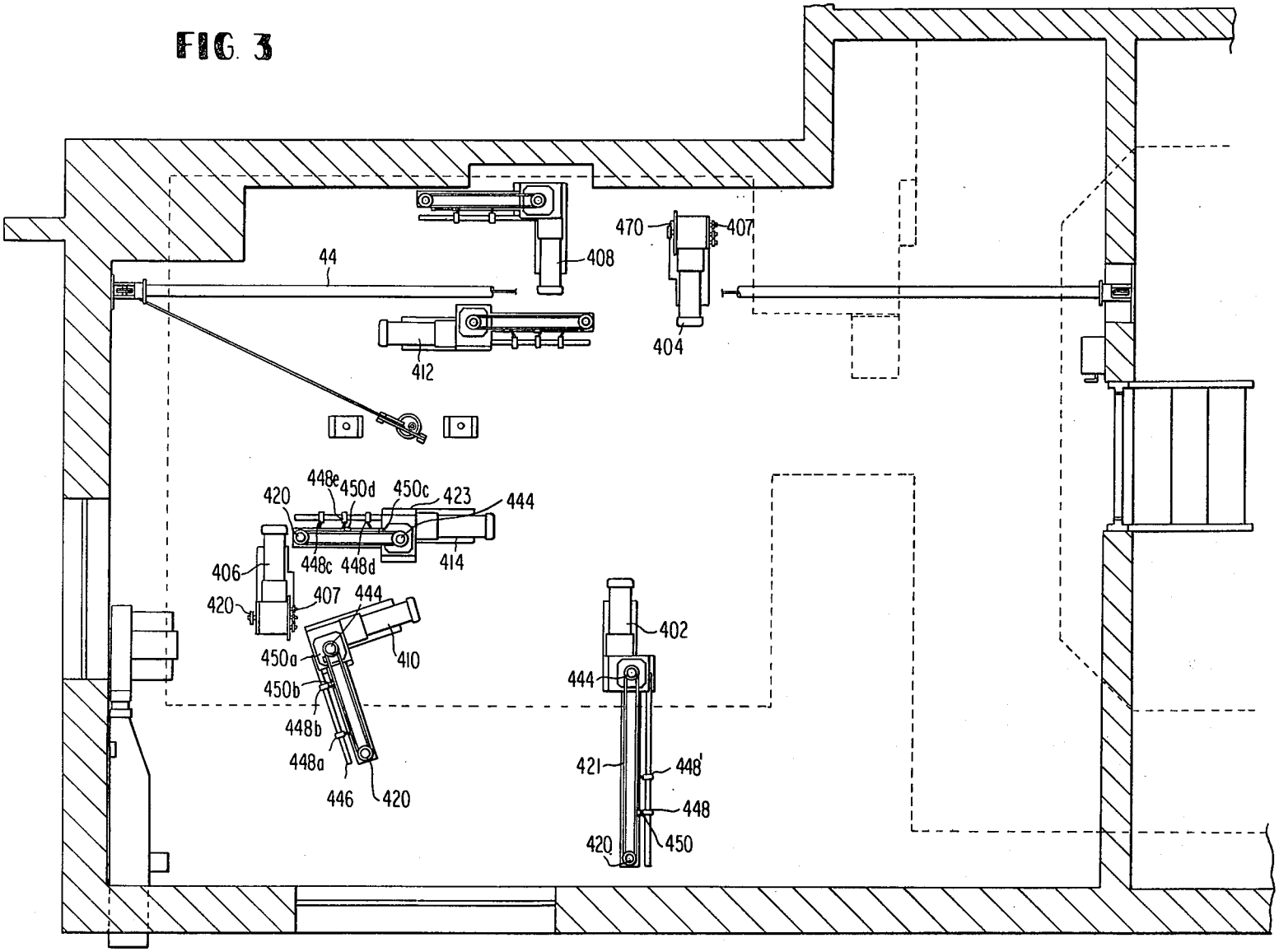
FIG. 3 is a top sectional view of an equipment room located directly above the radiation chamber of FIG. 2.

Turning now to FIG. 3, the several drive motors for the conveyor systems are shown. The floor plan of the cell and adjoining labyrinth are illustrated in dotted outline, for perspective. The motor 402 is operable to drive the shuffler 320; motors 404, 406 drive paddle conveyors 280, 280', respectively; motors 408, 410 drive packers 322, 324, respectively; and motors 412, 414 drive rack and pinion mechanisms 260', 260, respectively.

Paddle conveyors 280, 280', as noted previously, are driven by a chain and sprocket arrangement 284, 282 within the cell, and thus, as seen in FIGS. 5 and 6, holes are bored through the floor of the room 400 so that the chain 284 may extend therethrough so as to be driven by the respective motors 404, 406 via sprockets 407.

The remaining devices, i.e. the packers, shuffler, and rack and pinion drives 260, 260' are all driven in a conventional manner by rotatable pinions. Thus, the drive motors for these devices include output shafts, these shafts extending through bore holes in the floor to the various pinions within the cell. In FIGS. 5 and 6, the shafts 422 for the pinions of the two packers 322, 324 and the shuffler 320 can be seen, while in FIGS. 7 and 8, the shafts for driving the pinions of rack and pinion devices 260, 260' are illustrated.

Turning again to FIG. 3, each of the drive motors comprises a motor housing 423 and an output gear 444. The output gears 444 are attached to the output shafts of the motors 402, 408, 410, 412 and 414 and drive further gears 420 via chains 421 as shown. Extending from the motor housings 423 are stationary rods 446 having contact switches 448 mounted thereon at predetermined intervals. These switches are engageable with one or more movable contacts mounted on the chain at predetermined positions such that upon a contact engaging and tripping a switch, the motor may be stopped. The positioning of the contacts on the chains 421 and the switches on the rods 446 act as "mechanical analogs" corresponding to the movements of the particular driven elements in the cell below. The operation of these analogs will first be described with reference to the drive motor 402, which controls the operation of the shuffler 320 within the cell.

In FIG. 3, the mechanical analog connected to the drive motor 402 is illustrated in the "rest" position, which corresponds to the fully retracted position of the shuffler 320. A contact or actuator 450 is located on the chain closely proximate the first switch 448 as shown. The chain itself is wrapped about the gear 420 and the output gear 444, and as mentioned above, the output gear 444 is integral with the shaft 422 which drives the pinion for the shuffler within the cell. The gear 420 itself serves no purpose related to the driving of any conveyor mechanism, but merely rotates with the gear 444 via the chain 421.

When the shuffler is to be operated to, for example, load a carrier from the shuttle 152 to a rack, the motor 402 is actuated and the gear 444, as viewed in FIG. 3, rotates clockwise as the shuffler in the cell below begins its travel. The contact 450 on the chain travels around the gear 420, and then around the gear 444, and then contacts the second switch 448', whereupon the motor 402 is stopped. At this point the shuffler is fully extended and has pushed the carrier from the shuttle 152 onto an adjacent rack 222. Of course, when one carrier is not already positioned on the rack 222, the shuffler may extend somewhat further than when the carrier being loaded is the second such carrier on the particular rack. In the former instance, if desired, the contact between the switch 448' and the contact 450 may be ignored, the motor stopping upon engagement between the contact 450 and the switch 448. The motor 402 is again actuated, this time in the reverse direction, and the contact 450 returns to its original position via the reverse of the path described above. At this point, it engages the switch 488, turning the motor off, the shuffler now being in its original retracted position.

When the shuffler is operating to unload a carrier from a rack onto the shuttle, the operation of the motor 402 is controlled via a carrier detector switch 460 arranged within the cell (see FIG. 9). This switch is operable to stop the motor 402 upon a carrier being situated in the proper position on the shuttle, the switch being activated when the stalk of a mushroom engages a rod 462 forming a part of the switch. The motor 402 is then actuated in the reverse direction, retracting the shuffler, and stops when the contact 450 again engages the first switch 448. It should be noted that the switch 460 is inoperable, i.e., its operation is ignored, at all times other than when a carrier is being transferred from a rack to the shuttle. A programmable controller 199, which will be described later, keeps track of the positions of the carriers within the cell, and of the particular operation to be performed. Thus, the controller will determine whether or not the switch 460 should be ignored, depending on the particular operation which is being performed within the cell.

The analogs for the motors 408, 410 operate in a substantially similar fashion, each having two switches controlling the stroke of the pushers 322, 324 located within the cell. However, the analogs for these two motors contain two contacts, rather than just one. When the motor 410, for example, operates the packer 324 when two carriers are on the rack, the first contact 450*a* will be carried around the gear 444, around the gear 420 and will contact the switch 448*a*, shutting off the motor. The motor 410 will then be actuated in the reverse direction until the contact 450*b* engages the switch 448*b*. When there is only one carrier on the rack, the stroke or displacement of the pushers can be greater, and thus in this instance the motor 410 drives the pusher until the contact 450*b* engages the switch 448*a*, the contact between contact 450*a* and switch 448*a* being ignored in a manner similar to that discussed above with respect to the switch 460. Thus, a longer stroke of the pusher 324 can be obtained. When the motor is driven reversely to retract the pusher, the contact 450*b* will engage switch 448*b* to shut off the motor as before.

In the case of motors 412, 414 which are used to drive the rack and pinion mechanisms 260', 260, the operation of the analogs is again similar; however, in this instance, there are three switches and two contacts. With reference to motor 414 in FIG. 3, the "rest" position of the contacts and switches is illustrated corresponding to the position shown in the bottom half of FIG. 4. When the gear 444 is rotated clockwise, corresponding to the rack 262 moving to the left in FIG. 4 to pick up a further rack 222, the first contact 450*c* travels around gear 444, around gear 420, and engages the first switch 448*c*, turning the motor off. This corresponds to the extent of leftward travel of the rack 262 of FIGS. 4 and 8. When the rack is driven back to the right in FIG. 8, the gear 444 will rotate counterclockwise until the second contact 450*d* engages the second switch 448*d*, stopping the motor. This corresponds to the position within the cell wherein the mushroom of a carrier is lined up with the packer 324 so that the positions of the carriers may be adjusted. After such adjustment, the motor 414 is again actuated and the gear 444 will again rotate counterclockwise until the second contact 450*d* engages the third switch 448*e*. This position corresponds to that at the bottom of FIG. 4, e.g. the "rest position" mentioned above.

Motors 404, 406 control the movement of the paddle conveyors 280, 280', which are chain driven rather than shaft driven, as previously discussed. On the side opposite the drive sprockets 407, these motors are provided with a driven sprocket 470 which corresponds to the drive gears 444 of the other motors. Since the paddle conveyors always operate in the same direction, they are accordingly easier to control by means of a mechanical analog. Accordingly, only one switch 448 and one contact 450 are needed. When the motor 404 or 406 is actuated, the contact 450 travels around gear 420, around driven sprocket 470 and contacts the switch 448, whereupon the motor is turned off. With each actuation of the motor, this process repeats. The length of the chain 421 in this instance, of course, corresponds to the distance traveled by a rack 222 in its movement from one side of the cell to the other.

The actuation of each of the motors 402–414 is carried out under the oversight and control of controller 199, which may be a programmable computer. The controller is also operable to control the operation of the several pneumatic cylinders discussed above, via a suitable source of compressed air and a valving network. The controller is suitably programmed in order to sequentially control the various operations of the entire system by outputting control signals to the various motors and pneumatic devices in a predetermined sequential order.

Thus, for example, the controller can "keep track" of the location and number of the carriers within and without the cell, and cause the conveyor systems to operate in a preordained manner so as to smoothly control the operation of the system, as will readily be understood by one of skill in the art.

The controller is also capable of automatically ceasing the operation of the various components of the system in the event of any error or problem that may develop. For example, if the controller receives a signal indicating that a safety line has been pulled or that a mat switch has been engaged when the source is up or ascending, the controller will cause the source to be returned to the pool bottom until the problem has been remedied and the controller reset. The controller may also be programmed so as to cease operation and lower the source if a signal indicating the completion of a given sequential step is not received, if the radiation level at points within and without the cell exceed a predetermined value, or if there is a drop in air pressure indicating a leak, etc.

The mechanisms and apparatus described herein have been articulated in order to teach one practical means for accomplishing the objectives of the invention. However, many of the specific movements described herein can be accomplished by means of other mechanisms, and many times of apparatus can be replaced by other apparatus that would suffice; and the limits of the invention are as described in the following claims.

What is claimed is:

1. An apparatus for the irradiation of materials comprising:

(a) a shielded irradiation chamber containing a source of ionization radiation;

(b) a plurality of carriers for holding material to be irradiated in said chamber;

(c) a plurality of racks, said racks each including means for supporting at least two such carriers in a horizontal arrangement with respect to each other;

(d) means for moving said racks in discrete increments in a direction parallel to the plane of said source on either side of said source in an endless rectangular horizontal path around said source such that the carriers are carried together in ranks of at least two on either side of the source; and (e) means for changing the horizontal location of said carriers in a direction normal to the plane of the source of radiation during the course of irradiation such that each carrier will occupy a different horizontal position in rank during successive cycles around the source of radiation.

2. The apparatus of claim 1, further comprising: means for packing said carriers in close proximity to each other on said rack and in close proximity to said source of ionizing radiation on each side of said source of ionizing radiation.

3. An apparatus for the exposure of materials to ionizing radiation comprising:

(a) a shielded irradiation chamber;

(b) a source of ionizing radiation arranged in a plane having one major vertical dimension and one major horizontal dimension;

(c) a mechanism for moving said source from a shielded vault into said chamber and returning said source to said shielded vault when not in use;

(d) a plurality of carriers for holding material to be irradiated within said chamber;

(e) a plurality of racks, each including means for receiving and supporting a rank of at least two of said carriers in a manner which permits movement of said carriers in a direction normal to the said source plane;

(f) a mechanism for moving each rack around said source including means for moving the racks from one end of said irradiation chamber to the other end and vice versa on respective opposite sides of the source in paths adjacent and parallel to said source plane such that the carriers are moved together in ranks of at least two in either side of the source, and for moving said racks each in turn from one side of said source plane to the other side and vice versa at respective opposite ends of the source; and (g) means for moving and packing said carriers supported on said racks normal to the source plane toward said source on opposite sides of the source so that said carriers are maintained in close proximity to the source.

4. An apparatus as claimed in claim 3 also including means for replacing said carriers with other carriers and for relocating said carriers on said racks relative to other carriers on said racks.

5. An apparatus as claimed in claim 4 wherein said relocating means includes means for transposing said carriers on said racks relative to other carriers on said racks.

6. An apparatus for the irradiation of materials comprising:

a shielded irradiation chamber containing a source of ionization radiation;

a plurality of carriers for holding material to be irradiated in said chamber;

entrance conveyor means including horizontal track means for moving said carriers into and out of said chamber;

a plurality of racks in said chamber, said racks each including horizontal track means for supporting at least two such carriers in a horizontal arrangement with respect to each other;

chamber conveyor means for moving said racks around said source of ionization radiation in an endless path; and means for moving the carriers on the horizontal track means of the racks in a direction normal to the plane of the source of radiation during the course of irradiation.

7. An apparatus as claimed in claim 6 wherein said chamber conveyor means includes front and rear conveyors for transporting said racks from one side of the chamber to the other and vice versa, respectively; and side conveyors having horizontal tracks for directing the racks from front to rear and vice versa, respectively, on opposite sides of said source of ionization radiation.

8. An apparatus as claimed in claim 6 wherein said carriers include top means for supporting said carriers on said track means of said entrance conveyor means and said track means of each of said racks.

9. An apparatus as claimed in claim 6 including means for moving said carriers on said track means of said racks adjacent said source of ionization radiation source on opposite sides thereof.

10. An apparatus as claimed in claim 9 wherein said chamber conveyor means includes front and rear conveyors for transporting said racks from one side of the chamber to the other and vice versa, respectively, and includes side conveyors having horizontal tracks for directing the racks from front to rear and vice versa, respectively, on opposite sides of said source of ionization radiation; said carriers include top means for supporting said carriers on said track means of said entrance conveyor means and of each of said racks; said track means of said racks extend in the same orientation parallel to the front and rear conveyors as they move around said source of ionization radiation; and said means for moving the carriers on the racks includes means for pushing the carriers inward toward the ionization source on opposite sides of said source of ionization radiation.

11. An apparatus as claimed in claim 10 including means for transposing said carriers on said racks relative to other carriers on said racks.

* * * * *

UNITED STATES PATENT AND TRADEMARK OFFICE

CERTIFICATE OF CORRECTION

PATENT NO. : 4,481,652

DATED : November 6, 1984

INVENTOR(S) : Jackson A. Ransohoff

It is certified that error appears in the above-identified patent and that said Letters Patent is hereby corrected as shown below:

Column 1, line 57, insert a period after "thicknesses"; delete "Same" and substitute therefor -- Said --.

Signed and Sealed this

*Third* Day of *September 1985*

[SEAL]

*Attest:*

DONALD J. QUIGG

*Attesting Officer* *Acting Commissioner of Patents and Trademarks - Designate*